United States Patent [19]

Pelster et al.

[11] 4,091,595

[45] May 30, 1978

[54] NETTING BAG MACHINE AND METHOD

[75] Inventors: Edwin Joseph Pelster, Pleasanton; Richard Franc Kipers, Danville; George Earl Kilner, Oakland, all of Calif.

[73] Assignee: Filper Corporation, Reno, Nev.

[21] Appl. No.: 705,654

[22] Filed: Jul. 15, 1976

[51] Int. Cl.[2] ..... B65B 61/00; B65B 9/14

[52] U.S. Cl. ..... 53/14; 53/29; 53/137; 53/183; 93/8 WA

[58] Field of Search ..... 53/29, 28, 183, 180 M; 53/137, 179, 14; 93/8 WA, 26, 27

[56] References Cited

U.S. PATENT DOCUMENTS

| | | | |
|---|---|---|---|
| 1,521,725 | 1/1925 | Stanley | 53/137 |
| 2,861,406 | 11/1958 | Holsman et al. | 53/29 |
| 3,492,775 | 2/1970 | Rhine et al. | 53/29 |
| 3,760,558 | 9/1973 | Kaminsky et al. | 53/183 |
| 3,939,628 | 2/1976 | Schjeldahl | 53/29 |

*Primary Examiner*—Travis S. McGehee

[57] ABSTRACT

A method and apparatus for continuously forming and filling bag-type packages from a continuous supply of tubular packaging material, such as the plastic mesh tubing or netting manufactured and sold by E.I. Dupont De Nemours & Co. under the trademark VEXAR. The tubular packaging material is drawn over a mandrel from the continuous supply in the rope form in which it is manufactured. The mandrel includes a hollow portion preferably having a cross-sectional area at least as great as that of the desired package. The open end of the tubular packaging material is clamped adjacent the mandrel, and the tubular material is partially slit to form a fill opening adjacent the desired site of the other end of the package, aligned with a corresponding fill opening in the mandrel. A first closure in the form of an elongate label is applied to the open end of the tubular packaging material adjacent the clamp and the desired contents of the package is inserted through the fill openings in the tubular packaging material and the mandrel. Thereafter the tubular packaging material is advanced, removing the partially-formed, filled package from the mandrel while drawing attached additional tubular packaging material onto the mandrel for formation of a subsequent package. The partially-formed, filled package is then severed from the continuous supply adjacent the fill opening and a second closure is applied to form a filled bag-type package. The package is thus filled while still integral to the continuous supply of packaging material, thereby eliminating any handling of unfilled, severed lengths of packaging material.

44 Claims, 39 Drawing Figures

NETTING BAG MACHINE AND METHOD

This invention relates to a method and apparatus for simultaneously forming and filling bag-type packages from a continuous supply of tubular packaging material, such as the plastic mesh tubing manufactured and sold by E.I. Dupont De Nemours & Co. under the trademark VEXAR.

Conventional packaging systems employing tubular packaging material from a continuous supply generally operate in accordance with either of two distinct techniques. According to a first technique, partially formed packages, generally in the form of bags open at one end, are formed and severed from the continuous supply of tubular material prior to filling. The open bags may be stored for subsequent use or may immediately be transferred to a filling station, either by hand or automatically. In any event, this approach necessitates the handling of the severed lengths of tubular packaging material comprising the open bags. The packaging material may often posseses physical characteristics which render the handling of such severed lengths difficult. For example, the packaging material may be quite thin, flexible and resilient, resulting in a tendency to slip, stretch, tangle and/or jam in the apparatus, particularly when handled in severed lengths.

The second technique tends to obviate this difficulty by filling the package prior to severing the packaging material from the tubular supply. According to this technique, a length of the tubular packaging material is generally gathered onto a sleeve-like member and the package contents are inserted through the sleeve. Closures, often in the form of clips, are applied to form a sausage-like package. This approach generally precludes the use of a continuous supply of tubular packaging material. Rather, only a finite length of tubular packaging material may be loaded onto the sleeve, necessitating frequent reloading and thereby resulting in intermittent operation. Moreover, the sausage-like shape of the package thus formed is often less desirable than a bag-type shaped package.

According to the present invention, a method and apparatus for simultaneously forming and filling bag-type packages from a continuous supply of tubular packaging material is provided. Tubular packaging material is drawn over a mandrel from the continuous supply. The mandrel includes a hollow portion preferably having a cross-sectional area at least as great as that of the desired package. The open end of the tubular packaging material is clamped adjacent the mandrel and the tubular material is partially slit to form a fill opening adjacent the desired site of the other end of the package, aligned with a corresponding fill opening in the mandrel. The desired contents of the package is inserted through the fill openings in the tubular packaging material and the mandrel and a first closure in the form of an elongate label is applied to the open end of the tubular packaging material adjacent the clamp.

After the contents have been inserted and the first closure has been applied, the tubular packaging material is advanced, removing the partially-formed, filled package from the mandrel while drawing attached additional tubular packaging material onto the mandrel for formation of a subsequent package. The partially-formed, filled package is then severed from the continuous supply adjacent the fill opening and a second closure is applied to form a filled bag-type package.

The package is thus filled while still integral to the continuous supply of packaging material, thereby eliminating any handling of unfilled, severed lengths of packaging material. Since a continuous supply of tubular packaging material is employed, the need for frequent reloading and the resultant intermittent operation is substantially eliminated.

Accordingly, it is an object of the present invention to provide a method and apparatus for simultaneously forming and filling bag-type packages from a continuous supply of tubular packaging material.

Another object of the present invention is to provide a method and apparatus for forming and filling packages from tubular packaging material without handling unfilled, severed lengths of packaging materials.

Still another object of the present invention is to provide a continuous method and apparatus for forming and filling bag-type packages from tubular packaging material.

Yet another object of the present invention is to provide an improved method and apparatus for forming and filling bag-type packages from a continuous supply of tubular thermoplastic netting such as Vexar.

These and other objects, features and advantages of the present invention will be more readily apparent from the following detailed description, wherein reference is made to the accompanying drawings, in which.

Figure 2:
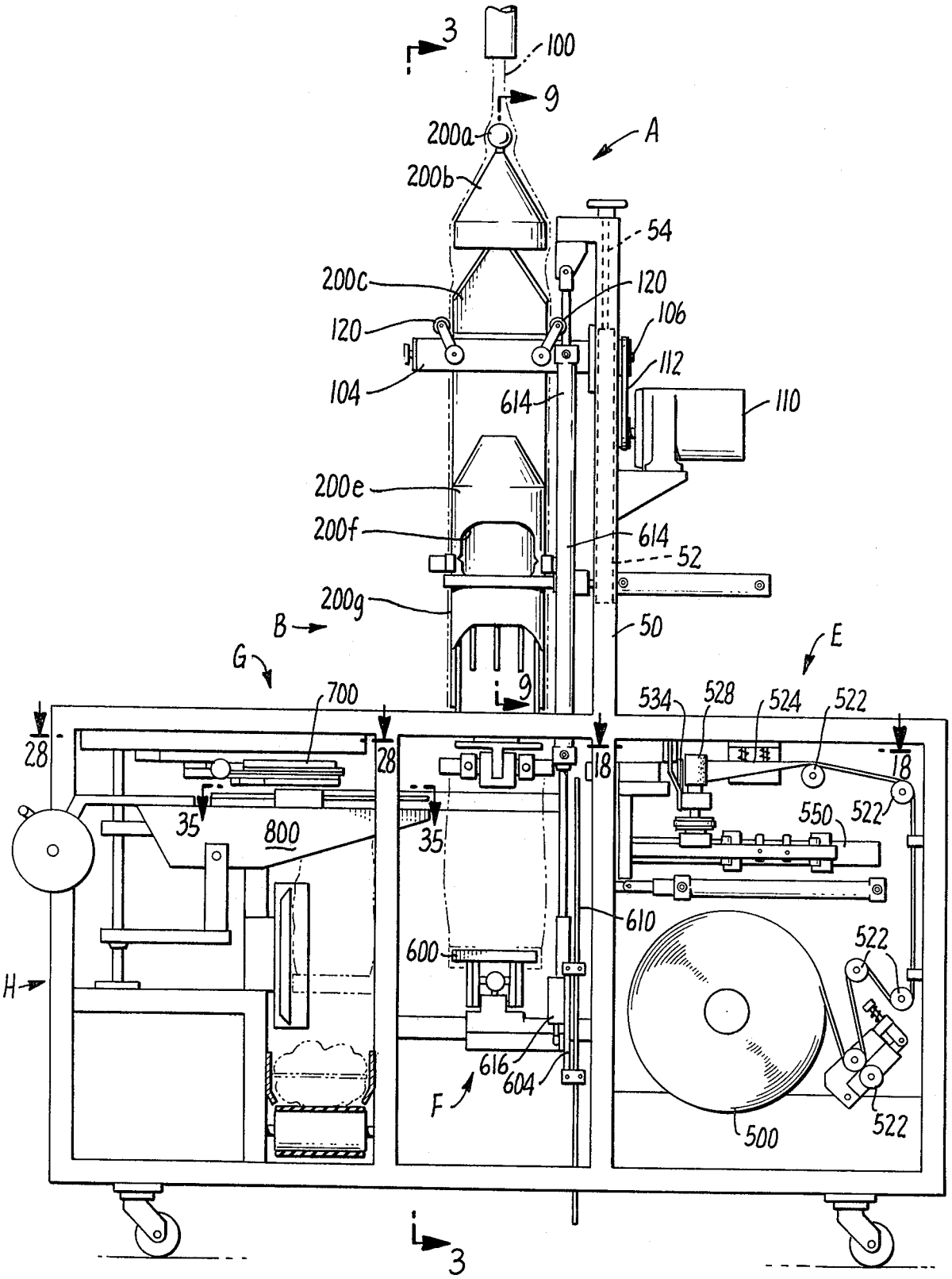
FIG. 2 is a front elevation view of the apparatus according to the preferred embodiment of the present invention.
Figure 31:
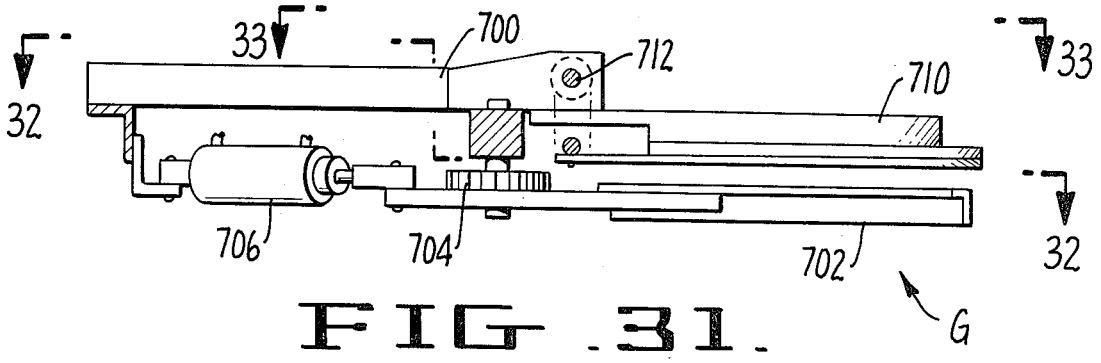
FIG. 31 is a sectional view taken along the line 31—31 of FIG. 28, showing the cut-off scissors mechanism.
Figure 32:
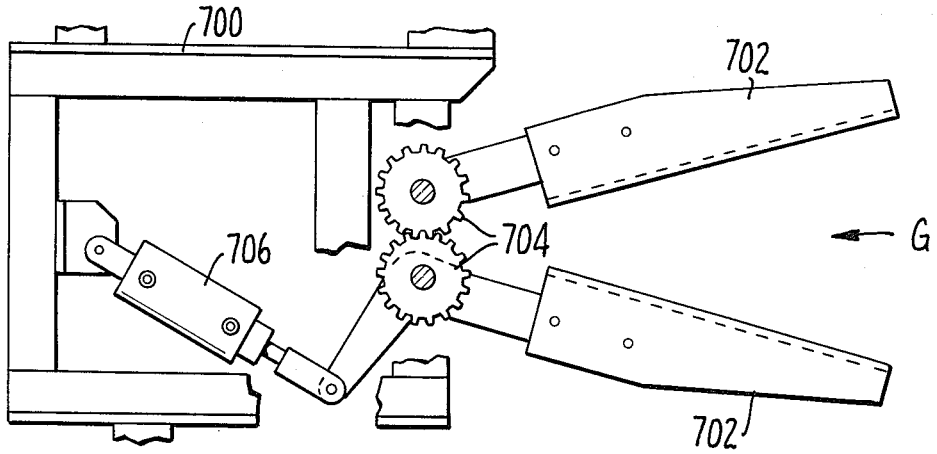
Figure 33:
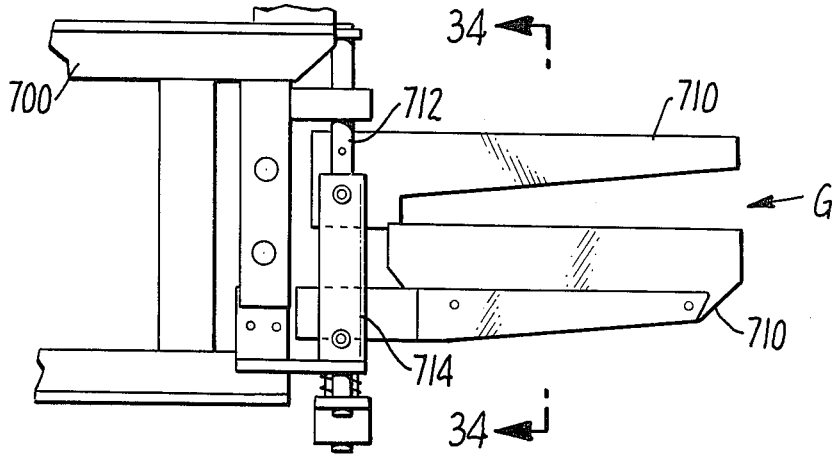
Figure 34:
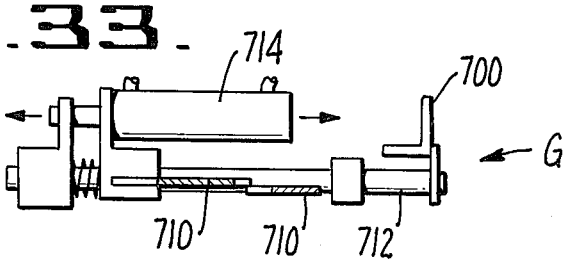
Figure 35:
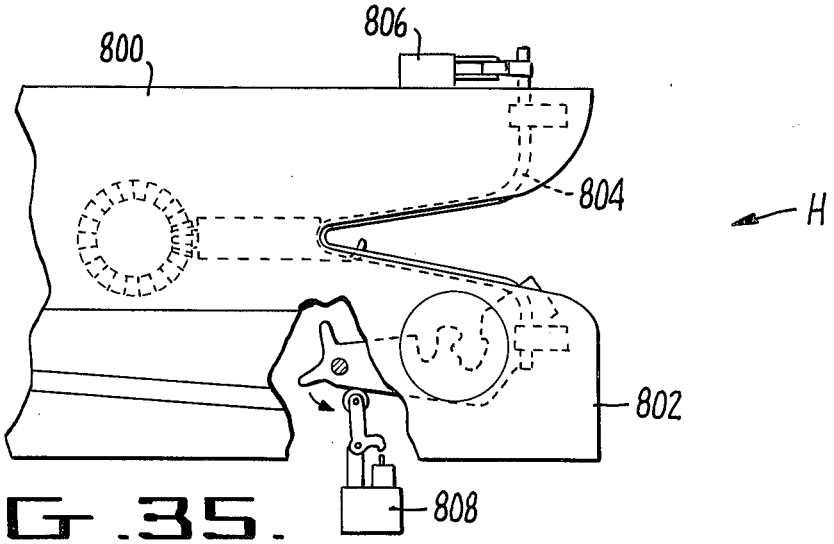
Figure 36:
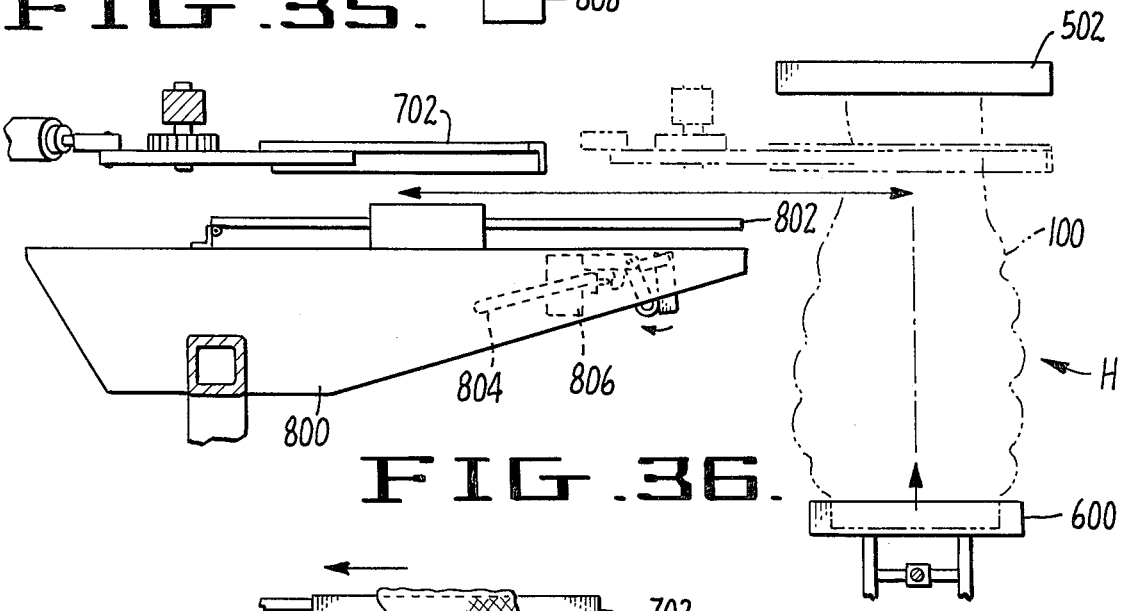
Figure 37:
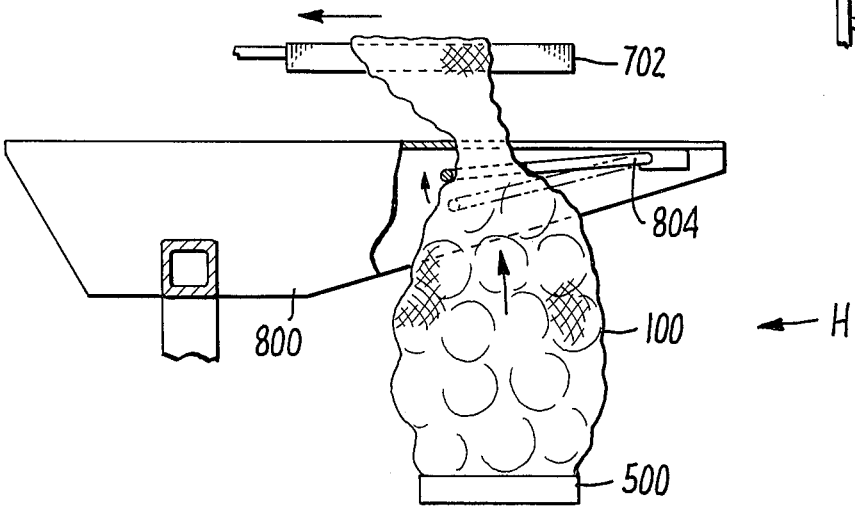
Figure 38:
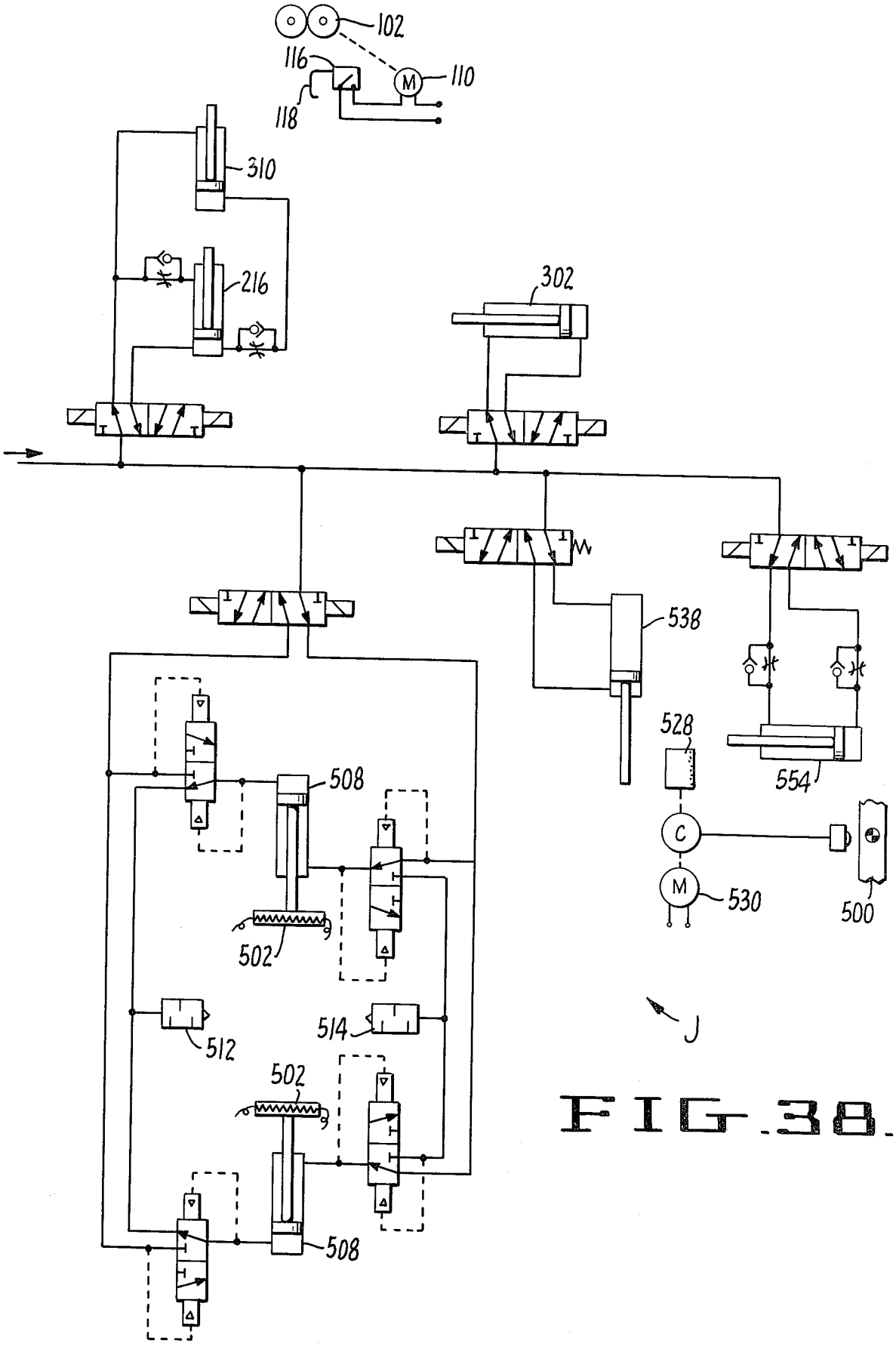
Figure 39:
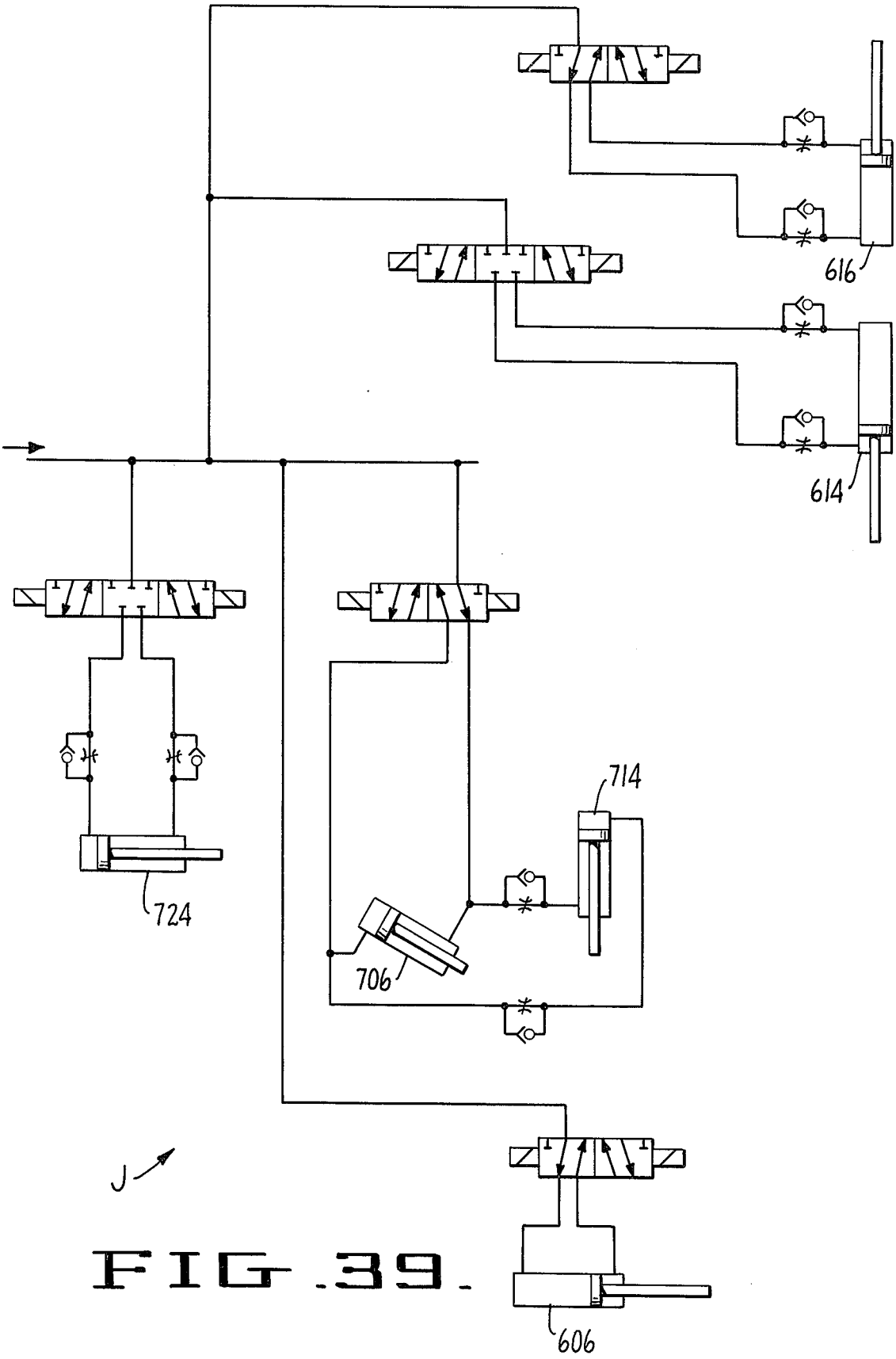

FIG. 32. is a sectional view taken along the line 32—32 of FIG. 31;

FIG. 33 is a plan view of the apparatus of FIG. 31 with the scissor mechanism closed;

FIG. 34 is a sectional view taken along the line 34—34 of FIG. 33;

FIG. 35 is a sectional view taken along the line 35—35 of FIG. 2, showing the bag closure mechanism;

FIG. 36 is an elevation view of the apparatus of FIG. 35 in relation to the transfer mechanism;

FIG. 37 is an elevation view similar to FIG. 36, showing the insertion of the package into the upper closure mechanism and;

FIGS. 38 and 39 are schematic diagrams of the control system of the apparatus of FIG. 2.

The method and apparatus for simultaneously forming and filling bag-type packages according to the present invention will now be described in detail with reference to the preferred embodiment, wherein it is desired to package generally spherical objects, such as oranges, in bag-type packages formed from a continuous supply of Vexar plastic mesh tubular netting 100.

In accordance with the method of the present invention, the netting 100 from the continuous supply is cross-sectionally expanded and gathered along its length into a relaxed supply of expanded netting. Netting from the relaxed supply is formed into a generally bag-type package shape, preferably over a hollow mandrel having a cross-sectional area at least as great as that of the desired package. The open end of the netting is clamped adjacent the mandrel to form a temporary lower closure for the bag-type package.

The netting is partially slit to form a fill opening adjacent the desired site of the other end of the package. The fill opening thus formed preferably aligns with a corresponding fill opening in the mandrel. The desired contents of the package is inserted through the fill openings in the netting and the mandrel.

A first closure in the form of an elongate label is applied to the open end of the netting adjacent the clamp. Such labels are formed in accordance with the present invention from a continuous supply of label material of double width. The label material is folded in half to form a "V" and severed into label lengths. The label thus formed is positioned with the clamped end of the netting interior of the "V" and the opposing faces of the label are heat sealed to form the lower closure.

After the contents have been inserted and the first or lower label closure has been applied, the netting material is advanced, removing the partially formed, filled package from the mandrel while drawing attached additional tubular packaging material onto the mandrel for formation of the subsequent package.

The partially formed, filled package is then severed from the continuous supply adjacent the fill opening and a second or upper closure is applied to form a filled bag-type package.

Figure 1:
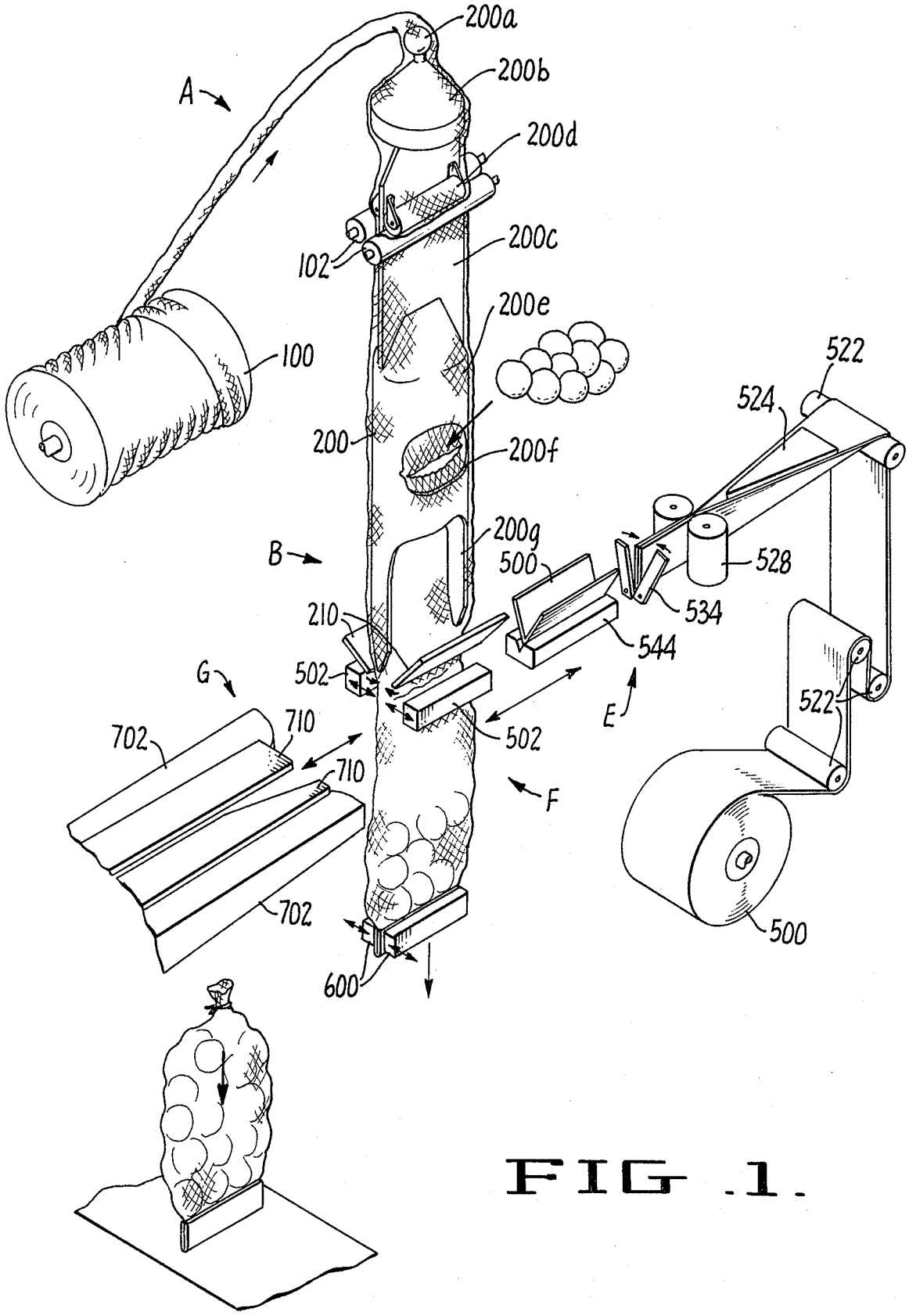
FIG. 1 is a diagramatic view of the method and apparatus for simultaneously forming and filling bag-type packages according to the preferred embodiment of the present invention.
Figure 3:
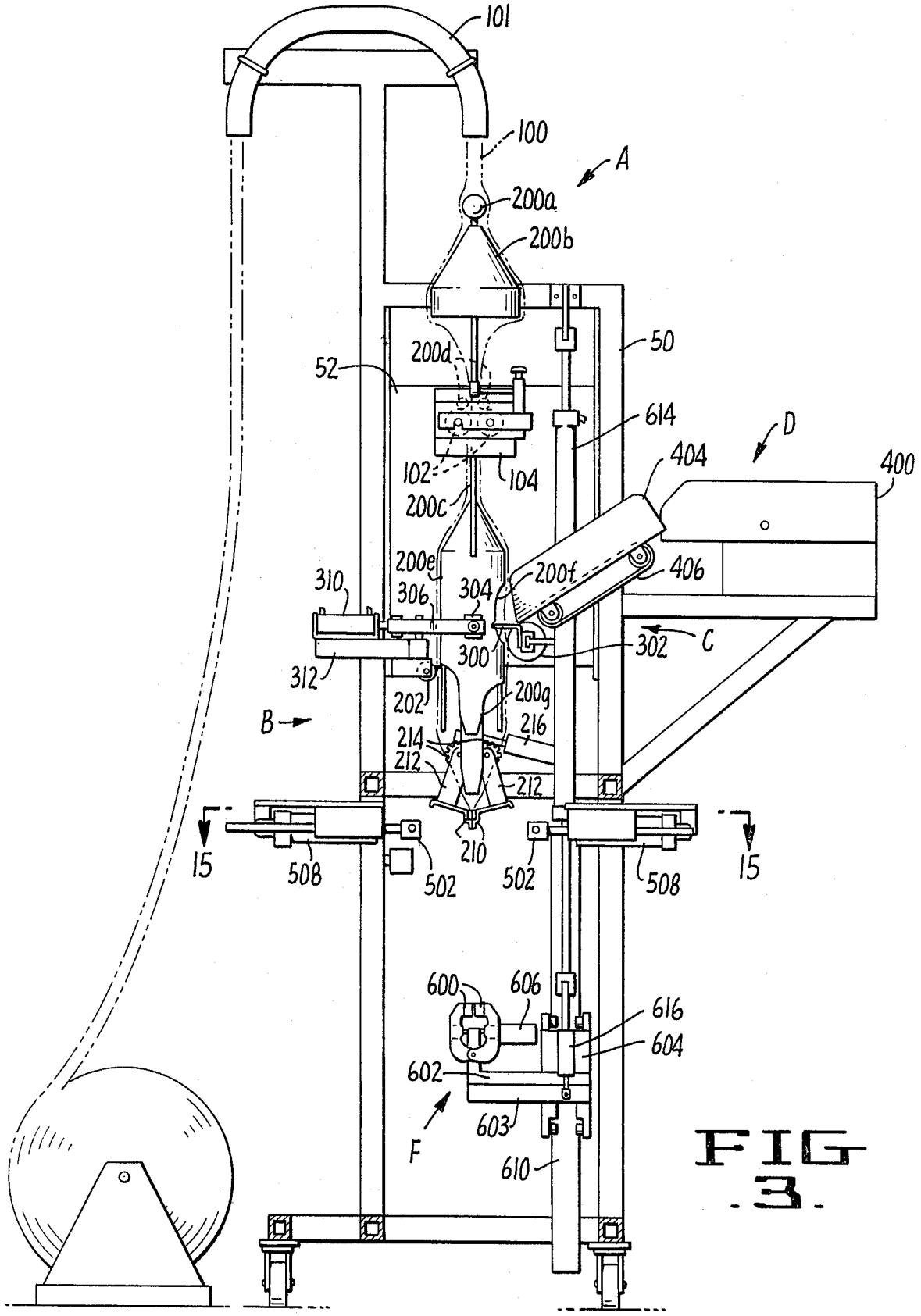
FIG. 3 is a side elevation view of the apparatus of FIG. 2.
Figure 4:
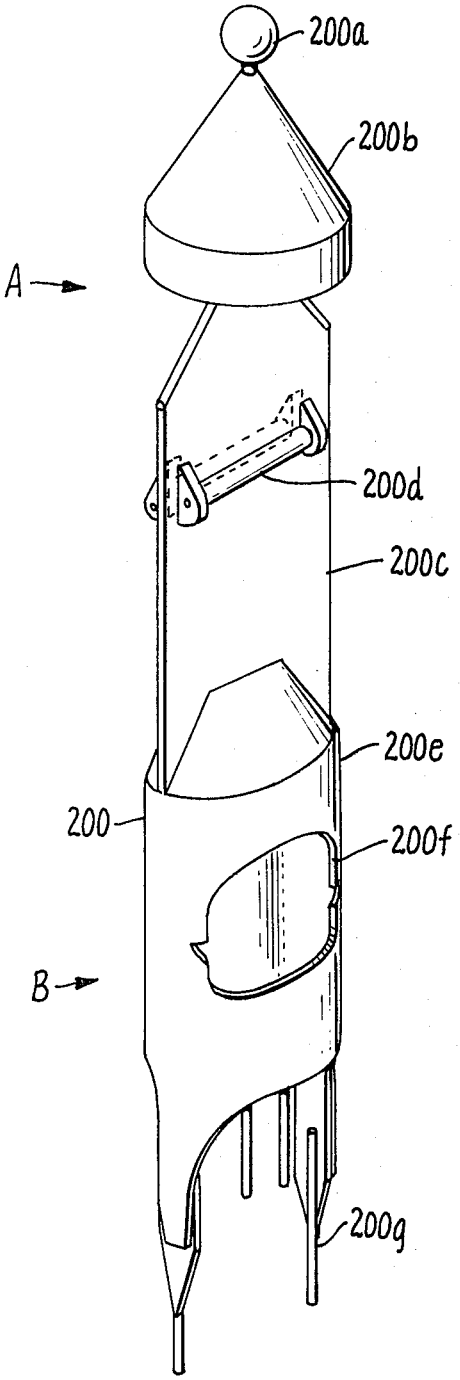
FIG. 4 is a perspective view of the mandrel portion of the apparatus of FIG. 2.

Referring initially to FIGS. 1-3, the apparatus of the present invention thus comprises a series of mechanisms operatively connected for repetitively effecting the steps heretofore described. Accordingly, there is provided a netting supply A to expand the netting cross-sectionally and gather the netting along its length into a relaxed supply. Package shaping means B is provided to form the netting into a generally bag-type shape with the open end of the netting temporarily clamped. Package shaping means B preferably comprises a mandrel 200 having a hollow lower portion 200g of a cross-sectional area at least as great as that of the desired package.

Fill opening formation means C is provided to partially slit the netting to form a fill opening adjacent the desired site of the other end of the package. The fill opening thus formed preferably aligns with a corresponding fill opening 200f in mandrel 200. Filling means D are provided to insert the desired contents of the package through the fill openings in the netting and the mandrel. Lower closure formation means E forms an elongate label-type closure from a continuous supply of label material and applies such label closure to the clamped open end of the netting.

Package advancement means F draws the partially formed, filled package from the mandrel while drawing attached additional tubular packaging material onto the mandrel for formation of a subsequent package. Package cut-off and transfer means G is provided to sever the partially formed, filled package from the continuous supply adjacent the fill opening and transfer same to upper closure formation means H for application of an upper closure to form a filled bag-type package.

A control system J is provided to synchronize the operation of the various mechanisms to implement the method as described.

NETTING SUPPLY A

Referring to FIGS. 4-10, netting supply A preferably comprises VEXAR plastic mesh tubular netting 100 supplied in a continuous rope form on an appropriate reel. The reel is shaft mounted for rotation to freely supply the netting 100 to the apparatus of the present invention. The netting 100 is directed through a hollow conduit 101 mounted on frame 50.

Figure 5:
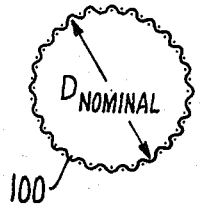
FIG. 5 is a cross-sectional view of the tubular packaging material employed according to the preferred embodiment of the present invention.
Figure 6:
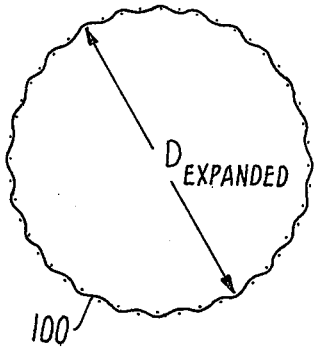
FIG. 6 is a cross-sectional view similar to FIG. 5, of the tubular packaging material expanded in accordance with the preferred embodiment of the present invention.
Figure 7:
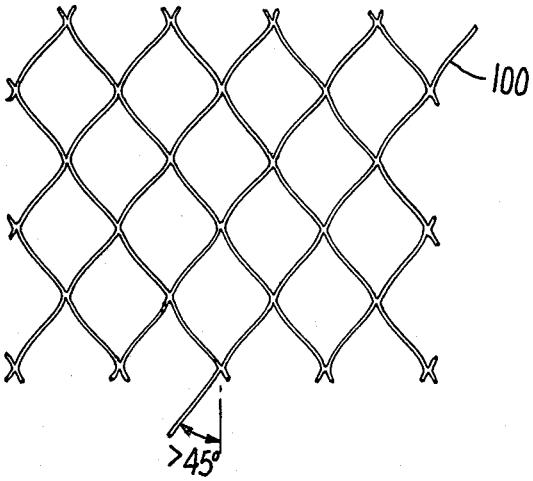
FIG. 7 is an elevation view of a portion of the tubular packaging material of FIG. 5.
Figure 8:
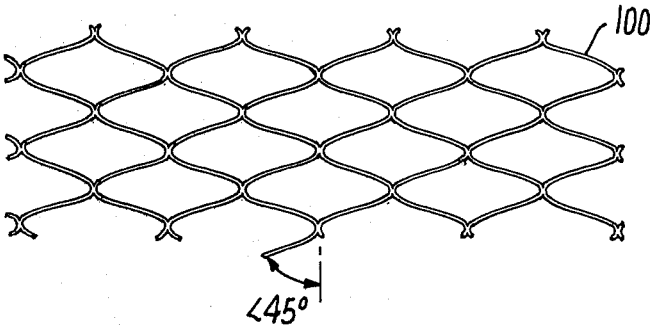
FIG. 8 is an elevation view, similar to FIG. 7, of the tubular packaging material of FIG. 6.

As best illustrated in FIGS. 5 and 7, the netting 100, as supplied, has a rather small diameter Dnominal generally defining a cross-sectional area substantially smaller than the desired cross-sectional area of the package. Thus, the netting supply A functions to cross-sectionally expand the netting 100 to define a cross-sectional area preferably somewhat greater than the desired cross-sectional area of the package. To this end, the netting 100 is drawn over a mandrel 200 which includes at its top a spherical portion 200*a* to center and guide the netting 100 onto a conical portion 200*b* of mandrel 200. Conical portion 200*b* possesses a maximum diameter defining a cross-sectional area somewhat greater than the desired cross-sectional area of the package. The netting 100 passing thereover is thus expanded as illustrated in FIGS. 6 and 8. Such over-expansion is preferably accomplished in consideration of the resilient nature of the Vexar netting 100. Specifically, after such cross-sectional expansion, the netting 100 will tend to cross-sectionally contract as a result of its resiliency.

The movement of the netting 100 thus described is accomplished by a pair of driven rollers 102 which are disposed about the mandrel 200. Mandrel 200 includes a generally flat sleeve-like portion 200*c* having a pair of idler rollers 200*d* mounted on opposite sides thereof for free rotation. Driven rollers 102 are mounted for rotation in a sub-frame 104 on shafts 106, 108, respectively. Shaft 106 is driven by a motor 110 through a belt and pulley arrangement 112. A pair of gears 114 on shafts 106 and 108 transfer the drive thus imparted to shaft 106 to shaft 108 as well. Driven rollers 102 are thus positioned for engagement with the idler rollers 200*d* of mandrel 200, with the netting 100 pinched therebetween. Rotation of driven rollers 102 thus draws the netting 100 over the spherical guide 200*a* and conical expansion portion 200*b* of mandrel 200 as heretofore described.

The operation of the driven rollers 102 is controlled to provide a gathered supply of netting 100 on the sleeve-like portion 200*c* of mandrel 200 below the rollers 102. Specifically, the operation of motor 110 is controlled by a microswitch 116 operated by a lever 118. As the netting 100 is gathered on sleeve-like portion 200*c*, the netting 100 will tend to urge lever 118 away from the sleeve-like portion 200*c*. Microswitch 116 and lever 118 are so configured that such motion of lever 118 will actuate microswitch 116, de-energizing motor 110, when an appropriate gathered supply of netting is present.

The netting supply A thus described provides a gathered supply of expanded netting on the sleeve-portion 200*c* of mandrel 200. In addition, the mechanism thus described functions to support the mandrel 200 within the netting 100. Specifically, the weight of mandrel 200 is supported by idler rollers 200*d* resting upon driven rollers 102. A pair of perpendicular rollers 120 are provided on opposite edges of the sleeve-like portion 200*c* adjacent driven rollers 102, to restrain the mandrel in the perpendicular direction. As will be more readily apparent hereinafter, the mandrel 200 thus floats within the netting 100, the weight thereof being borne by idler rollers 200*d* acting upon driven rollers 102 of the netting supply A.

PACKAGE SHAPING B

Referring now to FIGS. 9 and 12–14, the package shaping means B will now be described in detail. Lower portion of mandrel 200 comprises a second generally conical expansion portion 200*e* which expands the netting 100 onto the package shaping portion 200*g* of mandrel 200. Package shaping portion 200*g* is hollow and is preferably shaped generally in accordance with the shape of the desired package. As mentioned briefly hereinbefore, it is preferable that the cross-sectional area of the hollow package forming portion 200*g* of mandrel 200 be greater than the desired cross-sectional area of the completed package. In this manner, insertion of the contents in facitated, while the resilient nature of the Vexar netting 100 will result in subsequent contraction forming a relatively tightly filled package.

Mandrel 200 includes a fill opening 200*f* positioned generally adjacent the desired top of the package, for insertion of the contents as will be described hereinafter. A support idler roller 202 is carried on a subframe 52 on the opposite side of mandrel 200 from the fill opening 200*f*, the netting 100 passing therebetween. Roller 202 functions to support and stabilize the mandrel 200 against the forces imparted thereto by the insertion of the package contents.

The bottom of the package shaping portion 200*g* of mandrel 200 generally defines the bottom of the package shape and thus tapers to a generally linear bottom shape. Package shaping means B comprises a clamp mechanism to temporarily close the open end of the netting 100 adjacent the bottom of package shaping portion 200*g* of mandrel 200 during filling. The clamping mechanism generally comprises a pair of clamps 210 carried on opposite sides of the netting 100 by a pair of arms 212 mounted for arcuate movement. Arms 212 are connected by a pair of gears 214 and a pneumatic cylinder 216 is provided between frame 50 and one of the arms 212. When pneumatic cylinder 216 is energized, the arm 212 attached thereto pivots, causing like movement of the other arm 212 through gears 214. The arcuate movement of the arms 212 urges the clamps 210 into engagement with one another, with the open end of the netting 100 clamped therebetween. A limit microswitch 218 is actuated by the cylinder 216, thereby providing a control signal when the clamps 210 are closed.

The netting 100 is thus shaped into the general form of the desired package about the hollow mandrel 200 with the open end thereof closed by clamps 210 adjacent the bottom of the mandrel 200. The particular package shape may be varied in two ways. First, the cross-section dimensions of the package may be changed by use of netting 100 of different diameters, with the substitution of different mandrels 200, cross-sectionally dimensioned for use with the different nettings. Second, the package length, determined by the vertical distance between the clamps 210 and the fill opening 200*f* on the mandrel, may be varied by vertical movement of the mandrel 200 relative to the clamps 210. To this end, subframe or plate 52, carrying the mandrel 200 and associated package shaping mechanisms as aforesaid, is mounted for vertical movement relative to frame 50. Specifically, a jackscrew 54 is provided to control the vertical positioning of the subframe 52 and thus the desired package length.

FILL OPENING FORMATION C

Figure 9:
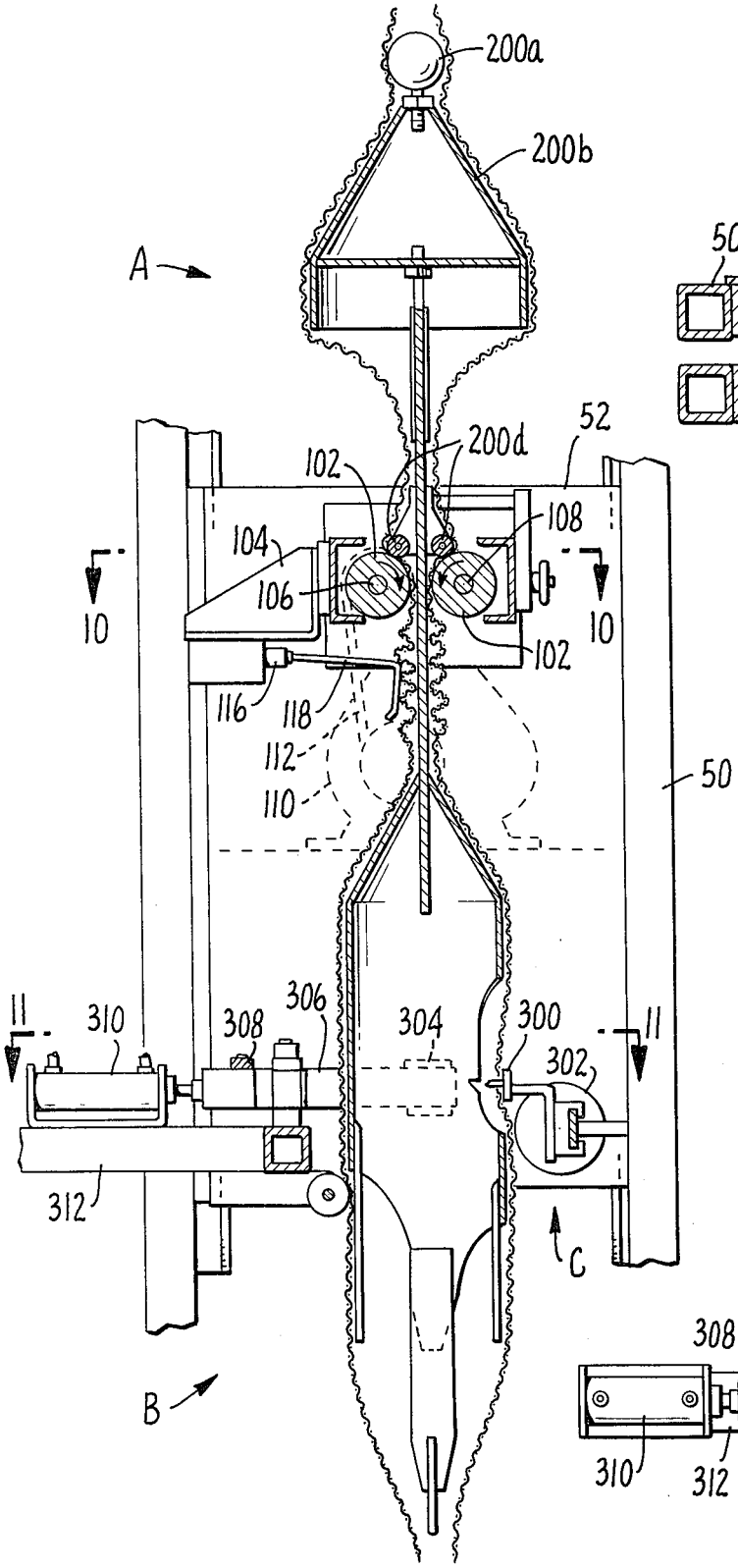
FIG. 9 is a cross-sectional view taken along lines 9—9 of FIG. 2 showing the netting supply, mandrel and fill opening mechanisms.
Figure 10:
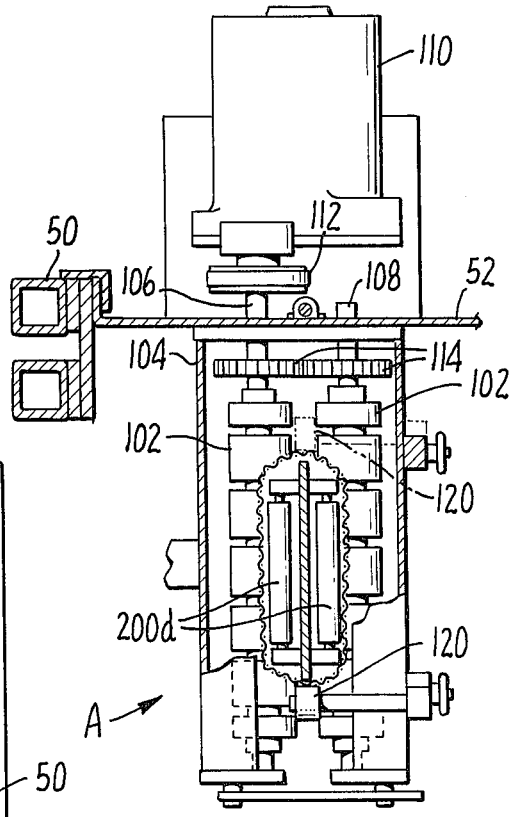
FIG. 10 is a sectional view taken along the line 10—10 of FIG. 9, showing the netting supply mechanism.
Figure 11:
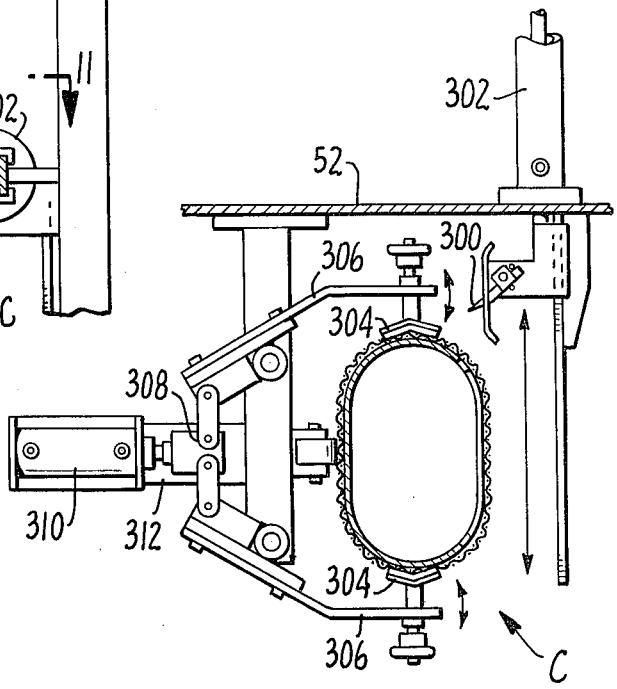
FIG. 11 is a cross sectional view taken along the lines 11—11 of FIG. 9, showing the fill opening mechanism.

Referring now to FIGS. 9 and 11, the fill opening formation means will now be described in detail. Specifically, there is provided a knife 300 mounted for movement with the shaft of a pneumatic cylinder 302. Cylinder 302 is mounted to subframe 52 and so aligned that the knife 300 traverses the fill opening 200*f* of the mandrel 200. Thus, energization of pneumatic cylinder 302 will result in the partial slitting of the netting 100 across the fill opening 200*f*, forming the desired fill opening in the netting aligned with the fill opening 200*f* of the mandrel 200.

In order to facilitate the operation of the slitter knife 300, the netting 100 is clamped onto the mandrel 200 adjacent the fill opening to provide a relatively taut section of netting 100 over the fill opening 200*f*. To this end, there are provided a pair of clamps 304 disposed on opposite sides of the mandrel 200 adjacent the fill opening 200*f*. Clamps 304 are respectively carried on a pair of arms 306, mounted to subframe 52 for pivotal movement. A linkage 308 is provided between the arms 306 and a pneumatic cylinder 310 carried on a subframe 312 mounted to subframe 52. Energization of cylinder 310 results in the pivotal movement of arms 306 through linkage 308, causing the clamps 304 to engage the netting 100 on the mandrel 200. The operation of cylinders 302 and 310 are suitably controlled to clamp the netting 100 prior to slitting and thus to provide a relatively taut segment of netting 100 over the fill opening 200*f* for ease of slitting. All of the fill opening formation mechanisms thus described are carried on subframe 52 so that alignment is maintained with the mandrel fill opening 200*f* regardless of the package length adjustment as aforesaid.

PACKAGE FILLING D

Figure 12:
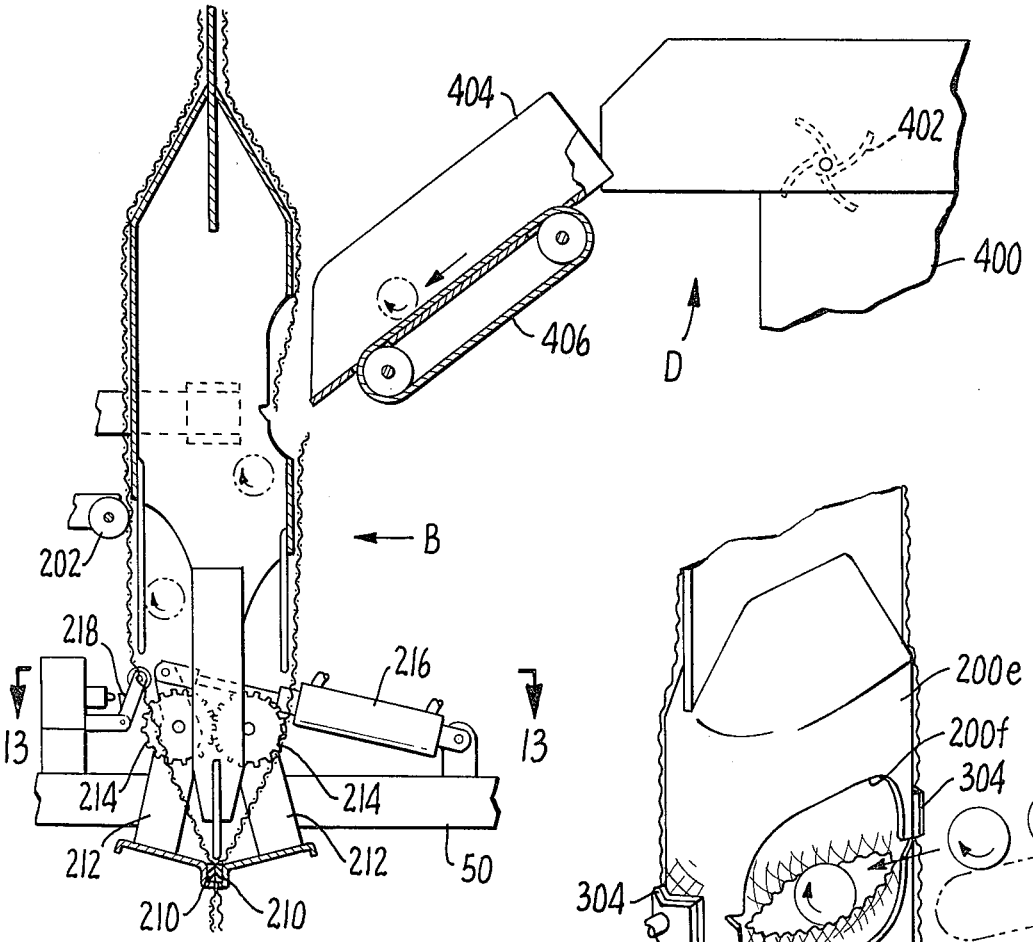
FIG. 12 is a cross sectional view, similar to FIG. 9, showing the mandrel, clamp and filling mechanism.
Figure 13:
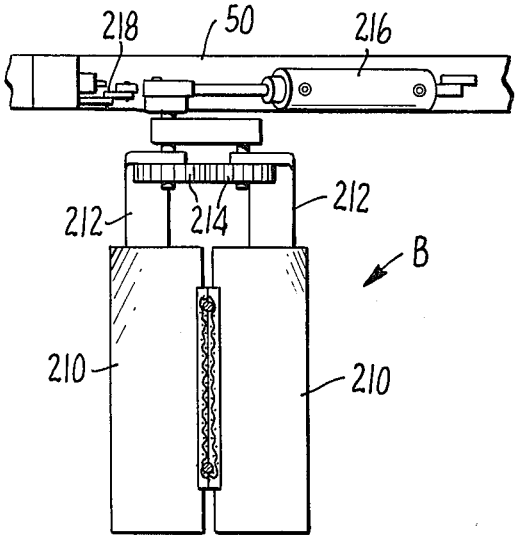
FIG. 13 is a sectional view taken along the lines 13—13 in FIG. 12, showing the clamp mechanism.
Figure 14:
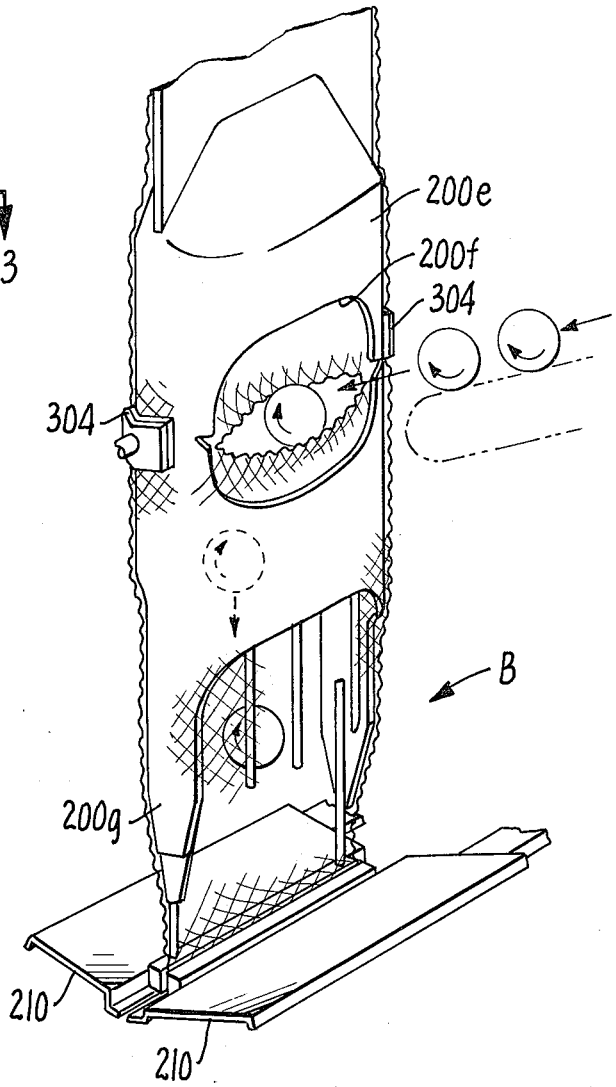
FIG. 14 is a perspective view of the apparatus of FIG. 12, illustrating the filling operation.

Referring now to FIGS. 12 and 14, the package filling means will now be described in detail. There is generally provided a supply 400 of the desired contents preferably comprising a conventional, counting, weighing or measuring dispenser adapted to handle the particular contents of the package. In accordance with the preferred embodiment of the present invention the package contents comprise spherical objects such as oranges, and the supply 400 is thus a conventional counting dispenser for same. The contents supply includes a counter mechanism 402 which detects the passage of each object and controls the operation of the supply 400 to dispense a predetermined quantity of contents for each package.

The contents are thus dispensed by supply 400 into an inclined chute 404 between the supply 400 and the fill opening 200*f* of mandrel 200. There is preferably provided a driven conveyor belt to accelerate the oranges down the chute 404. In the case of spherical objects such as oranges, such acceleration will impart a backspin to the oranges, as illustrated by the arrows in FIGS. 12 and 14. Such spinning causes the oranges to rebound off the interior wall of mandrel 200 and propel downwardly to the bottom of the package. In this manner, the contents tend to expand and fill the bottom of the package.

LOWER CLOSURE FORMATION E

Figure 15:
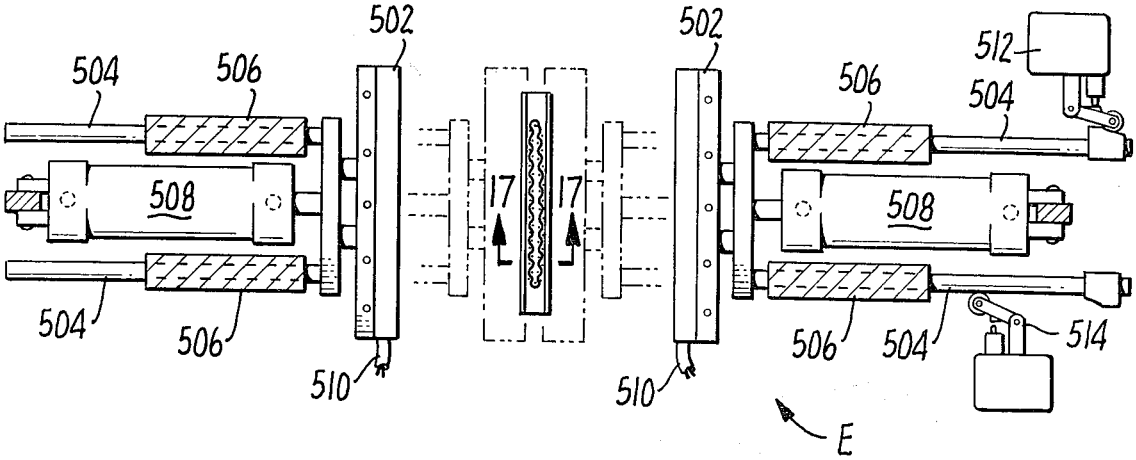
FIG. 15 is a sectional view taken along the line 15—15 of FIG. 2, showing the lower closure heatsealer.
Figure 16:
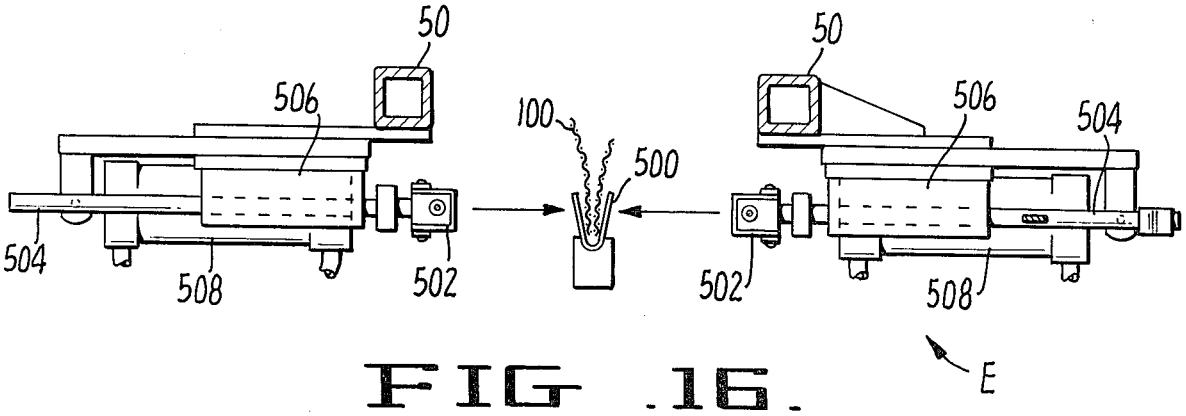
FIG. 16 is a side elevation of the apparatus depicted in FIG. 15.
Figure 17:
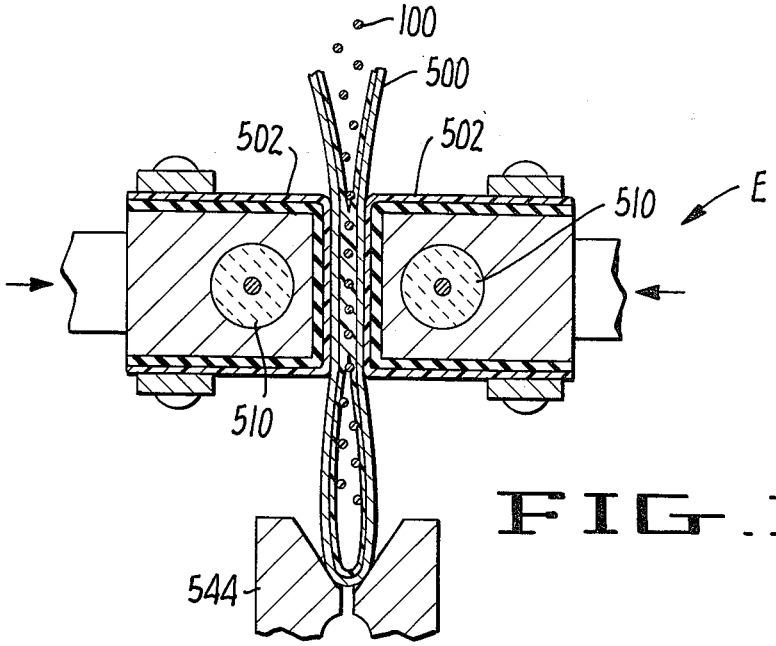
FIG. 17 is an enlarged side elevation of a portion of the apparatus of FIG. 16, showing the sealing of the lower closure and label.
Figure 18:
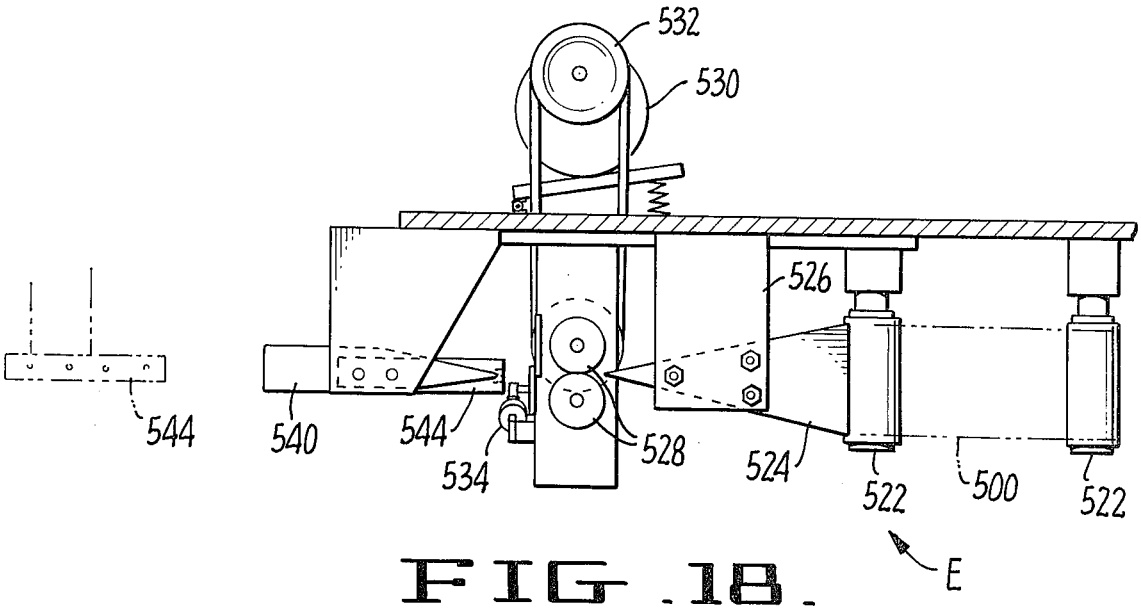
FIG. 18 is a sectional view taken along the line 18—18 of FIG. 2, showing the label forming mechanism.
Figure 19:
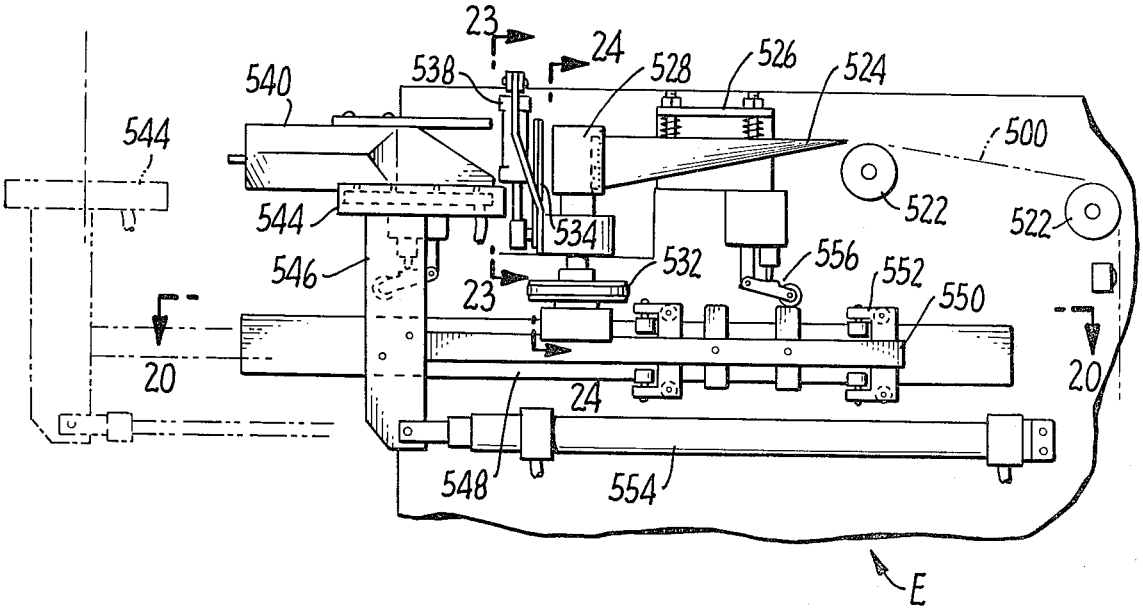
FIG. 19 is a side elevation view of the apparatus depicted in FIG. 18.
Figure 20:
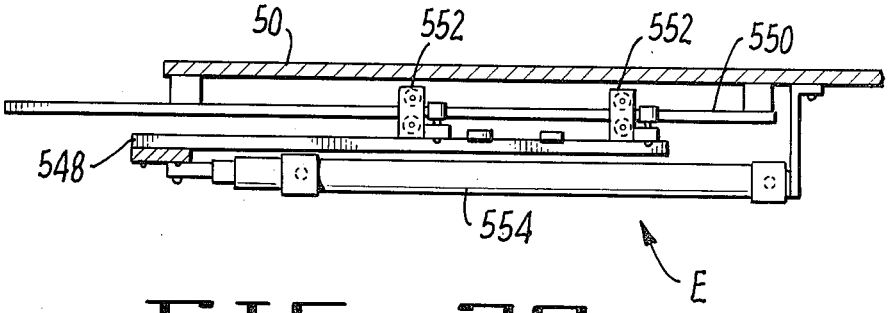
FIG. 20 is a sectional view taken along the line 20—20 of FIG. 19, showing a portion of the label transfer mechanism.

Referring now to FIGS. 15–17, the application of the lower closure will now be described in detail. As briefly referred to hereinbefore, lower closure 500 preferably comprises a "V"-folded strip of label closure material of a length corresponding to the width of the open end of the netting 100 clamped by clamps 210. As will be described in greater detail hereinafter, lower closure 500 is positioned adjacent clamp 210, with the end of netting 100 disposed within the "V" thereof. A pair of heated platens 502 are provided on opposite sides of the closure 500. Each of the platens 502 is carried on the ends of a pair of rods 504 slidably mounted by bearing blocks 506 mounted to frame 50. A pair of pneumatic cylinders 508, mounted between frame 50 and the platens 502, are provided to urge platens 502 inwardly, toward one another. Each of the platens 502 includes a tubular electrical heating element 510 disposed therein.

To apply closure 500 to the open end of the netting 100 adjacent clamp 210, the pneumatic cylinders 508 are energized, causing heated platens 502 to bear upon one another, with the closure 500 captured therebetween, as best illustrated in FIGS. 17. The closure 500 is provided with a heat activatable coating on the inner surface thereof, which is softened by the heated surfaces of the platens 502. The opposed inner faces of the closure 500 are thus adhered to one another through the interstices of the netting 100 so as to form a transverse label-type closure bonded to and closing netting 100 adjacent clamps 210.

After a time sufficient to bond the heat activatable coating to form the closure, cylinders 508 are de-energized, causing the platens 502 to move apart releasing the closure. The action of cylinders 508 is controlled by the control system to be described hereinafter. The position of the platens 502 is inputted to the control system by a pair of microswitches 512 and 514 operated by the movement of the rods 504. Specifically, microswitch 512 is activated when the platens 502 are retracted, as illustrated in FIG. 15. Similarly, microswitch 514 is activated when the platen 502 are extended.

Referring now to FIGS. 18–25, the formation of the closure 500 will now be described in detail. According to the preferred embodiment of the present invention, the closure is formed from a continuous supply of double width label material 500 provided in roll form and mounted for rotation. The label material 500 is threaded over a plurality of idler rollers 522 to a folding mandrel 524, spring mounted to the frame 50 by a bracket 526.

Figure 25:
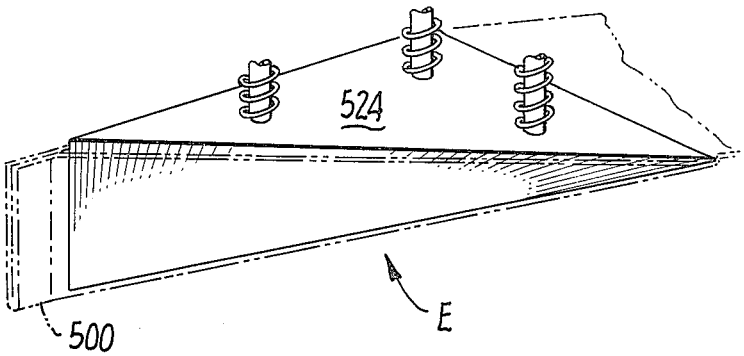
FIG. 25 is a perspective view of the label forming mandrel of the apparatus of FIG. 19.

As best seen in FIG. 25, folding mandrel 524 is suitably shaped so that the label material 500 drawn thereover is folded in half. The label material 500 is drawn over folding mandrel 25 by a pair of rollers 528 disposed adjacent the output of the folding mandrel 524 with the folded material 500 pinched therebetween. One of the rollers 528 is driven by a motor 530 via an electric clutch 532. Thus, the rotation of motor 530 causes roller 528 to draw the label material over folding mandrel 524 to form the fold therein as desired.

Figure 23:
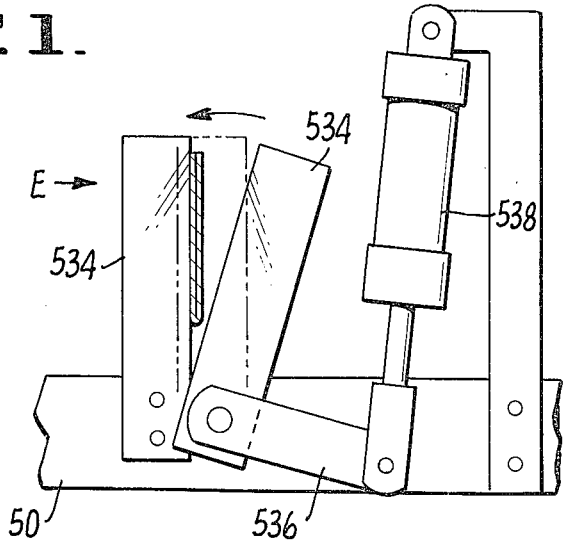
FIG. 23 is a sectional view taken along the line 23—23 of FIG. 19, showing the label cutting mechanism.
Figure 24:
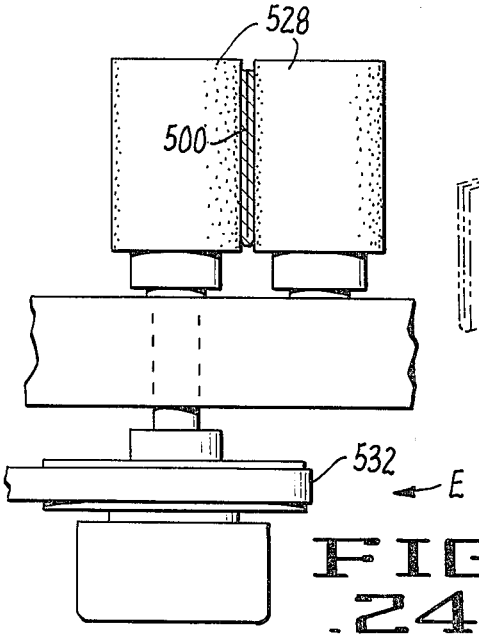
FIG. 24 is a sectional view taken along the line 24—24 of FIG. 19, showing the label creasing mechanism.

A label cutter scissors 534 is disposed on the opposite side of rollers 528. Scissors 534 are connected via a linkage 536 to a pneumatic cylinder 538, which serves to actuate the scissors 534, as best illustrated in FIG. 23. Thus, when cylinder 538 is energized, scissors 534 closes, severing the folded label material 500 into the desired label closure length. The operation of cylinder 538 is controlled by a photocell which detects indexing marks preprinted on the label material at distances corresponding to the desired label length.

Figure 21:
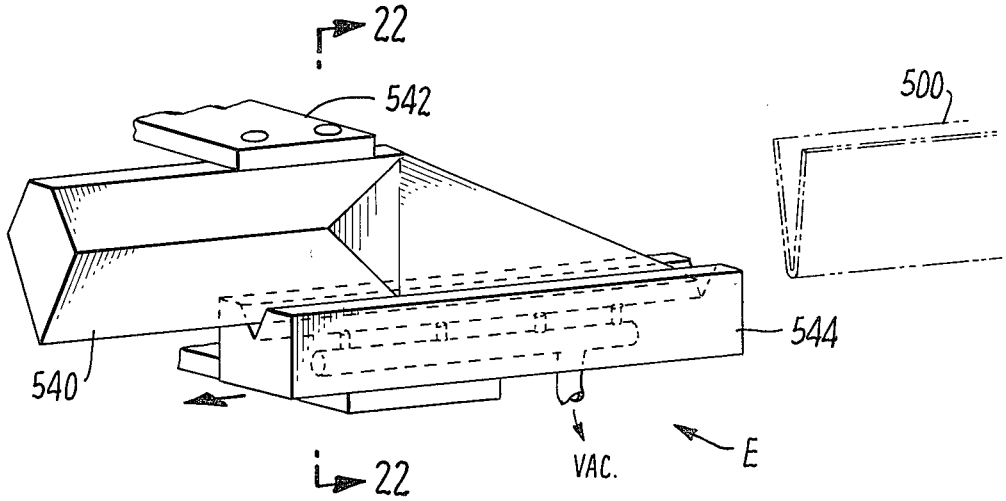
FIG. 21 is a perspective view of a portion of the appartus of FIG. 19 showing the label opening mandrel and vacuum transfer shoe.
Figure 22:
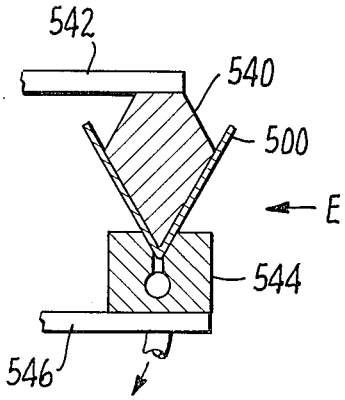
FIG. 22 is a sectional view taken along the line 22—22 of FIG. 21.

A label opening mandrel 540 is mounted on a bracket 542 adjacent scissors 534. Mandrel 540 is suitably shaped to open the folded label material 500 to form the desired "V"-shape, permitting entry of the netting 100 between the opposed faces thereof, as best illustrated in FIGS. 21 and 22. Thus, the folded label material 500 is advanced through open scissors 534 and unfolded by mandrel 540 prior to the energization of cylinder 538. Accordingly, the lengths of label material severed by scissors 534 are formed into the desired "V"-shape, prior to severing from the continuous supply.

In order to transfer the severed length of label material from the opening mandrel 540 to the open end of the netting 100 adjacent clamp 210, a vacuum transfer shoe 544 is provided on a movable carriage which, in its retracted positon disposes transfer shoe 544 adjacent mandrel 540 and in its extended position disposes transfer shoe 544 adjacent the open end of the netting 100. Specifically, vacuum transfer shoe 504 is carried on a vertical arm 546 connected to a horizontal arm 548. Arm 548 is connected to a parallel arm 550 mounted for sliding movement in a pair of rolling bearing assemblies 522. A pneumatic cylinder 554 is mounted between frame 50 and arm 548 to extend and retract the carriage thus formed.

Accordingly, a vacuum supply is connected to the vacuum transfer shoe 544 so that the severed length of label closure material 500 on mandrel 540 will be adhered to the vacuum transfer shoe 544 is translated from the retracted position adjacent mandrel 540 to the extended position adjacent the open end of the netting 100. The length of label closure material 500 is thus positioned for application to the open end of the netting as heretofore described. When the platens 502 engage the label closure 500, the vacuum is released on the label transfer shoe 544, and the cylinder 544 is de-energized, causing the carriage to retract the vacuum shoe 544. The sequencing of the cylinder 544 relative to operation of the other mechanisms is controlled by the control system J as will be described hereinafter. Microswitches 556, operated by cams on the carriage assembly, are provided to input the position of the vacuum transfer shoe 544 to the control system.

PACKAGE ADVANCEMENT F

Figure 26:
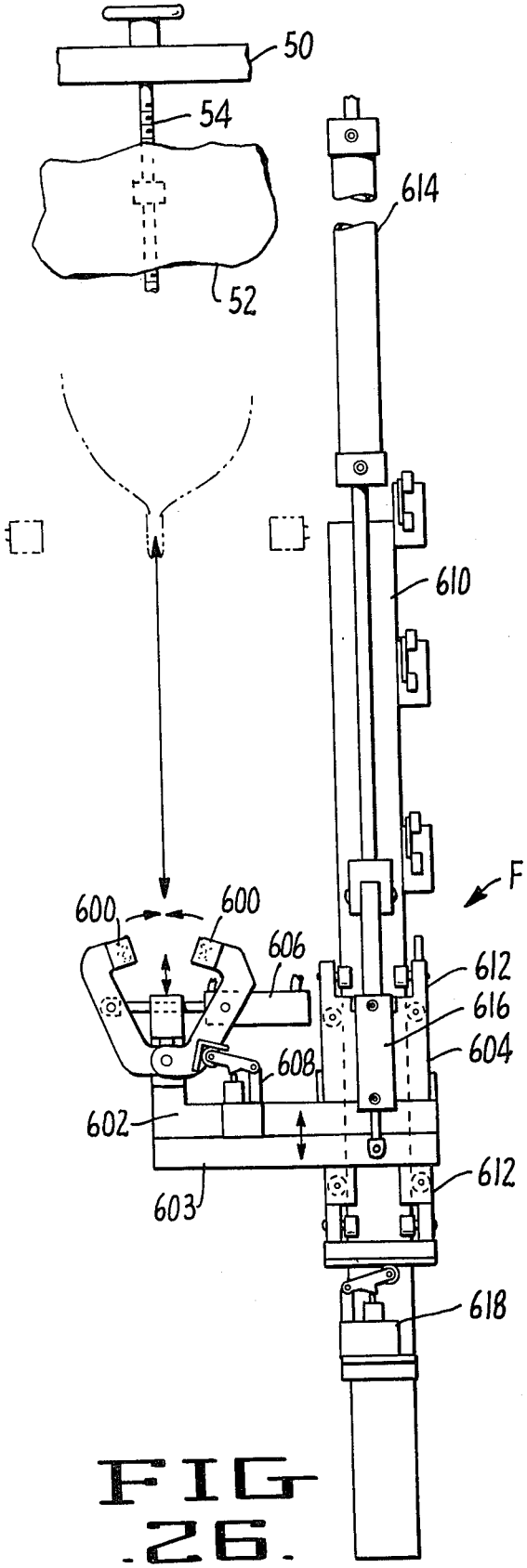
FIG. 26 is a side elevational view of the package advancement mechanism of the apparatus of FIG. 2.
Figure 27:
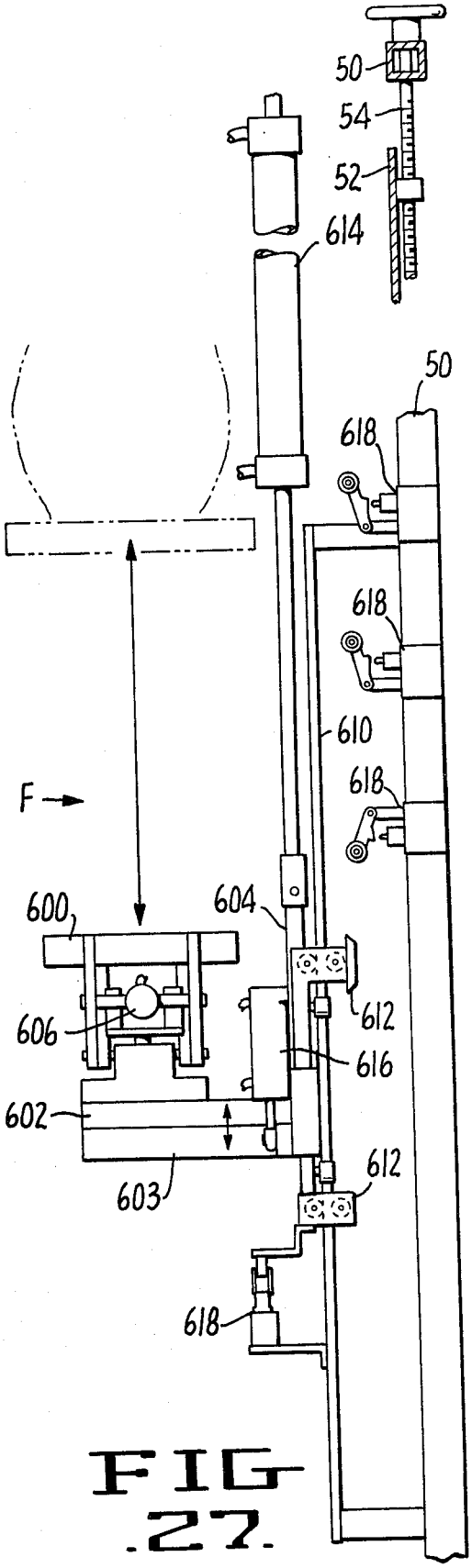
FIG. 27 is a front elevation view of the apparatus of FIG. 26.
Figure 28:
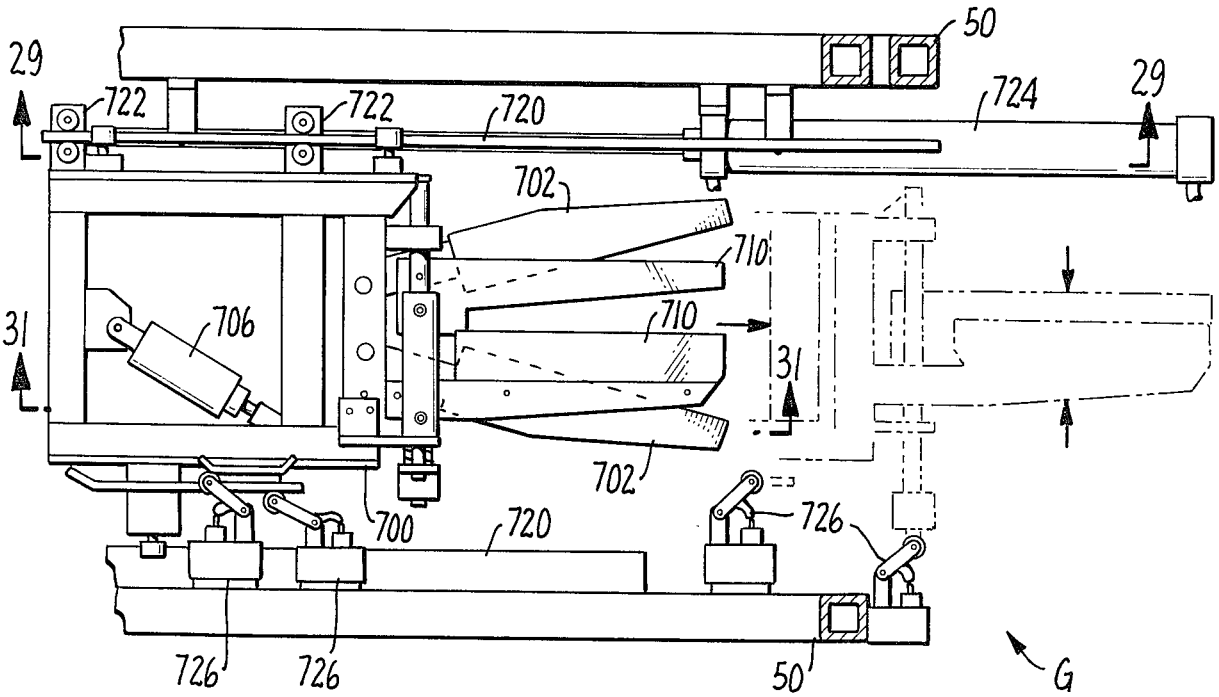
FIG. 28 is a sectional view taken along the line 28—28 of FIG. 2, showing the cut-off and transfer mechanism.
Figure 29:
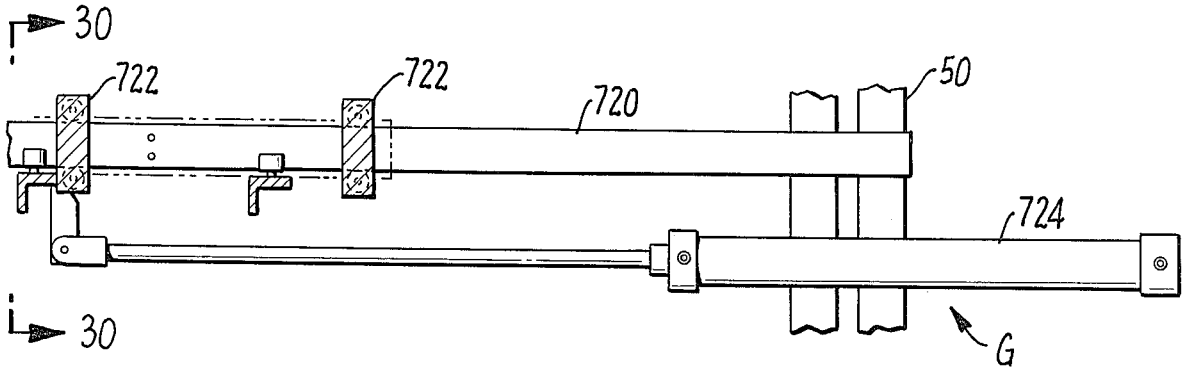
FIG. 29 is a sectional view taken along the line 29—29 of FIG. 28, showing a portion of the transfer mechanism.
Figure 30:
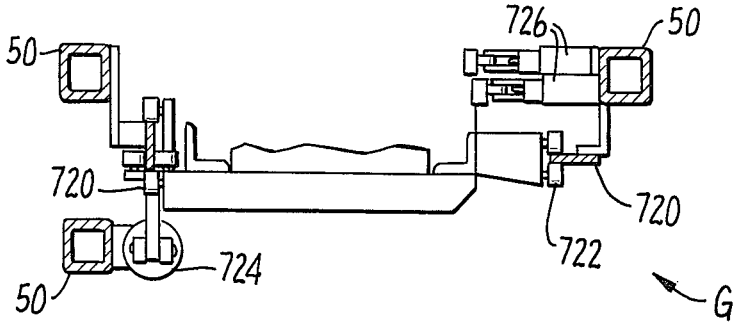
FIG. 30 is a sectional view taken along the line 30—30 of FIG. 29.

Referring now to FIGS. 26 and 27, the advancement of the partially-formed, filled package off of the mandrel 200 will now be described in detail. A pair of package advancement clamps 600 are mounted for pivotal movement on a horizontal arm 602, carried on a vertical carriage 604. A pneumatic cylinder 606 is mounted between the clamps 600 so that the energization of the cylinder 606 will cause the clamps 600 to pivot inwardly, toward one another, to grasp the label closure 500 between the opposed faces of the clamps 600. Similarly, when cylinder 606 is de-energized, the clamps 600 open, releasing the label closure 500. The operation of the cylinder 606 is suitably sequenced by the control system, as will be described hereinafter. To this end, a microswitch 606, actuated by one of the clamps 600, is provided to input to the control system the position of the clamps 600.

Carriage 604 is mounted for vertical movement on a track 610 carried on frame 50 by a pair of roller bearing assemblies 12. A pneumatic cylinder 614 is connected between the frame 50 and the carriage 604, to drive the carriage 604 vertically on the track 610. Specifically, the stroke of cylinder 614 is adjusted to correspond to the desired package length and thus, cylinder 614 functions to draw the carriage upwardly to enable the clamp 600 to grasp the label closure 500. Cylinders 614 then causes the carriage 604 to travel downwardly, with the label closure 500 grasped by clamps 600, to draw the partially formed, filled package downwardly off the mandrel while drawing attached additional netting gathered on portion 200c of mandrel 200 downwardly onto portion 200g of the mandrel 200 for fomation and filling of a subsequent package in like manner.

A second or bumping pneumatic cylinder 616 is provided between horizontal arm 502 and a parallel arm 603 rigidly mounted to carriage 604. Clamps 600 carried on arm 602 are thus vertically movable relative to carriage 604 and arm 603, by operation of cylinder 616. After cylinder 614 draws the partially formed, filled package downwardly, cylinder 616 is energized to urge the clamps upwardly a short distance, bumping the package to settle the contents therein.

The action of cylinders 614 and 616 is sequenced by the control system, as will be described hereinafter. To this end, a plurality of microswitches 618 actuated by the travel of the carriage 604 are provided to input to the control system the position of the carriage 604.

PACKAGE CUT-OFF AND TRANSFER G

Referring now to FIGS. 28–34, the cutoff of the filled package from the continuous supply of netting 100 and the transfer of same to the upper closure mechanism will now be described in detail. A transfer carriage 700 is provided with a pair of transfer clamps 702 pivotally mounted thereto. Clamps 702 are geared together by gears 704 and a pneumatic cylinder 706 is provided between one of the clamps 702 and the transfer carriage 700, as best seen in FIG. 32. Thus, energization of cylinder 706 will cause transfer clamps 702 to pivot inwardly, capturing the netting 100 between the opposed faces of the clamps 702.

The netting is thus clamped to permit severing of the filled package from the continuous supply of netting 100. To this end, a pair of scissor arms 710 are disposed adjacent transfer clamps 702. As best seen in FIGS. 33 and 34, one of the scissor arms 710 is slidably mounted on a rod 712 and a pneumatic cylinder 714 is provided between the slidable scissor arm 710 and the transfer carriage 700. Thus, energization of cylinder 714 will urge the slidable scissor arm 710 towards the fixed scissor arm 710, severing the netting 100 therebetween. The filled package is thus severed from the continuous supply of netting 100 with the upper end thereof clamped between transfer clamps 702.

Transfer carriage 700 is slidably mounted on a pair of rails 720 by roller bearing assemblies 722. A pneumatic cylinder 724 is provided between the frame 50 and the transfer carriage 700 to transfer the severed package to the upper closure mechanism. Specifically, when cylinder 724 is retracted, the transfer carriage 700 is positioned beneath the mandrel 200 to permit the package to be clamped by transfer clamp 702 and severed by scissor arms 710. Extension of the cylinder 724 translates the transfer carriage 700, with the filled package clamped by transfer clamp 702, to the upper closure mechanism H for formation of the upper closure of the package.

The sequencing of the cylinders 706, 714 and 724 is accomplished by the control system of the present invention, as will be described hereinafter. To this end, a plurality of microswitches 726 are provided to input to the control system the position of the transfer carriage 700.

UPPER CLOSURE FORMATION H

Referring now to FIGS. 35–37, the upper closure formation according to the present invention will now be described in detail. In accordance with the preferred embodiment of the present invention, the upper end of the package is gathered and tied closed by a conventional twist tieing machine 800. One of such machines referred to as a Doboy Super Mini Tie, is made by Doboy Packaging Machinery, Domain Industries, Inc. of New Richmond, Wisconsin. In this machine a length of paper or plastic covered wire called "ribbon" is folded into a "U" around the gathered bag neck and the ends of the "U" are then twisted tight around the severed neck.

In accordance with the present invention, the Doboy Super Mini Tie Machine 800 is provided with a guideplate and trigger mechanism adapted to snug the netting 100 about the top or neck of the package to insure a relatively tight fit of the package about the contents thereof. To this end, there is provided a guideplate 802 having a "V"-shaped slot into which the neck of the package is gathered by movement of the transfer clamp 702 thereabove. A "V"-shaped lever 804 is pivotably mounted below the corresponding V of guideplate 802, inclined with respect thereto as illustrated in FIG. 36. Lever 804 actuates a microswitch 806 which in turn energizes the Doboy Twist Tieing Machine 800.

As the clamped open end of the package is guided into the Doboy Twist Tie Machine 800 by the translation of the transfer clamp 702, the clamped end of the package passes within the "V"-shaped slots of guideplates 802 and lever 804. As the translation of transfer clamp 702 continues, the translation of the package will be impeded at the apex of the "V" and thereafter, further translation of transfer clamp 702 will urge the package upwardly, with the contents captured in the "V" of lever 804. In this manner, the netting 100 is drawn tautly about the contents until sufficient force is imparted to lever 804 to cause the same to rotate, actuating microswitch 806 and thereby energizing the Twist Tie Machine 800.

A completed package is thus formed having a twist tie at one end applied by the Doboy Twist Tie Machine 800 as described. The control system then releases cylinder 706, causing transfer clamps 702 to open, releasing the package. To this end, there is provided a microswitch 808 actuated by operation of the Doboy Twist Tie Machine to input to the control system the completion of the upper closure. The completed package is thus released, marking the end of the operation. of the present invention with respect to a particular package.

CONTROL SYSTEM J

Referring now to FIGS. 38 and 39, the control system of the apparatus of the present invention functions to sychronize the operation of the various mechanisms as heretofore described. The various pneumatic cylinders are schematically illustrated in FIGS. 38 and 39, bearing the same reference numbers as employed in the other views. The remaining elements comprise conventional valves, check-valves and metering orifices (designated by their conventional schematic symbols) to accomplish the control of the apparatus as desired.

OPERATION

The sequencing of the various mechanisms heretofore described, to accomplish the formation and filling of bag-type packages on a repetitive basis, will now be described. It is to be expressly understood that the apparatus of the present invention simultaneously operates upon several packages in different stages of formation. Thus, the following cycle of operation will be described with reference to three packages designated as package *n*, package $n+1$, and package $n+2$. Prior to commencement of one cycle of operation to be described, the status of the packages is as follows: Package *n* is substantially completed, having received its upper closure, but remains grasped by the transfer clamps 702; package $n+1$ is filled and has a lower label closure, but remains disposed about portion **200*g* of mandrel 200**; and package $n+2$ has yet to be formed. With the foregoing in mind, the sequence of steps of one cycle of operation of the apparatus of the present invention is as follows:

1. Pneumatic cylinders 706 and 714 retract, causing transfer clamps 702 and scissor arms 710 to open, releasing the completed package *n*.
2. Cylinder 614 retracts, urging carriage 604 upwardly, to dispose the label closure of package $n+1$ between the open package advancement clamps 600.
3. Cylinder 606 retracts, causing package advancement clamps 600 to close, capturing the label closure of package $n+1$ therebetween. Cylinder 216 retracts and cylinder 310 extends, causing clamps 210 and 304 to open, releasing package $n+1$ from the mandrel 200.
4. Package advancement clamps 600 travels downwardly through the extension of cylinder 614, drawing package $n+1$ off of the mandrel 200 while simultaneously drawing attached additional netting gathered on portion **200*c* of mandrel 200 downwardly onto portion 200*g*** for formation of the subsequent package $n+2$.
5. During the downward travel of package advancement clamp 600, pneumatic cylinder 724 extends, translating transfer carriage 700 toward its extended position beneath the mandrel 200 with the top of package $n+1$ disposed between the open transfer clamps 702 and scissor arms 710.
6. When the package advancement clamps 600 reach the end of their downward travel, cylinder 216 extends and cylinder 310 retracts, closing clamps 210 and 304 to clamp the netting about the mandrel 200 for formation of package $n+2$. Cylinder 302 is then energized, causing knife 300 to traverse the fill opening **200*f*, forming a fill opening for package $n+2$. The package contents supply 400 is then energized, causing a predetermined quantity of package contents, such as oranges, to be dispensed into the package $n+2$ through the fill opening thus formed. Simultaneously, pneumatic cylinder 706 extends, causing transfer clamps 702 to clamp the top of package $n+1$ and cylinder 714 extends, causing the scissor arms 710 is sever package $n+$from the continuous supply of netting 100**.
7. Upon completion of the cutoff of packages $n+1$ by scissors 710, cylinder 606 extends, causing the package advancement clamps 600 to open, releasing the label closure of package $n+1$. Cylinder 724 retracts, causing the transfer carriage 700 to translate package $n+1$ toward the upper closure formation machine 800.
8. During retraction of the transfer carriage 700, one of the microswitches 726 is actuated causing cylinder 554 to extend, translating the vacuum transfer shoe 544 from its retracted position adjacent mandrel 540 toward the open end of the netting 100 adjacent mandrel 200.
9. When transfer carriage 700 reaches the end of its stroke, the package $n+1$ will rotate lever 804, actuating microswitch 806 and thereby energizing the twist tie machine 800, resulting in the application of the upper closure to package $n+1$.

10. When the vacuum transfer shoe 544 reaches its fully extended position, with the open end of package $n+2$ disposed in the "V" of the length of label closure material 500 carried thereon, one of the microswitches 556 is actuated, extending cylinders 508, to urge heated platens 502 inwardly, toward one another.

11. When the heated platens 502 close about the label closure 500, a heat sealing timer is commenced. The vacuum is released on vacuum transfer shoe 544, releasing the label closure 500, and the cylinder 554 retracts, causing the vacuum transfer shoe 544 to retract. Cylinder 538 extends, causing label cutter scissors 534 to open.

12. When the vacuum transfer shoe 544 reaches its fully retracted position adjacent mandrel 540, one of the microswitches 556 is actuated, engaging electric clutch 532 resulting in the advancement of label material 500 by rollers 528.

13. When the next indexing mark pre-printed on the label material 500 is detected by the photocell, electric clutch 532 is disengaged and the vacuum on vacuum transfer shoe 544 is activated. After a short time delay, cylinder 538 is retracted, causing label cutter scissors 534 to sever the length of label closure material held by vacuum transfer shoe 544 from the supply.

14. After completion of the heat-sealing time interval, the cylinders 508 retract, causing the heated platens 502 to release the completed lower label closure of package $n+2$, marking the end of a single cycle of operation.

While a particular embodiment of the present invention has been shown and described in detail, it is apparent that adaptations and modifications may occur to those skilled in the art. It is to be expressly understood that such adaptations and modifications are within the scope of the present invention, as set forth in the claims.

What is claimed is:

1. A method for forming and filling packages from tubular packaging material in a continuous supply comprising the steps of: forming the open end of said tubular material into a hollow configuration generally defining a package shape, clamping the open end of said material to define a generally flat outwardly extending section of said material, positioning a "V"-shaped elongate label closure about the outwardly extending section of said material, adhering the opposing faces of said label closure with said section of material therebetween to form a first closure, forming a fill opening in said material adjacent the desire site of the other end of said package, filling said material through the fill opening therein with the desired contents of said package, severing said material from the continuous supply adjacent said fill opening subsequent to filling.

2. The method according to claim 1 comprising the step of longitudinally folding the end of a continuous supply of double-width label closure material to define a length of "V"-shaped label closure material sufficiently dimensioned to receive the outwardly extending section of said material and severing said length of label closure material from the continuous

3. The method according to claim 1 wherein the step of forming a fill opening comprises transversely slitting a portion of said material.

4. The method according to claim 1 wherein the open end of said material is directed downwardly to form and fill said package in vertical orientation.

5. A method for forming and filling packages from tubular packaging material in a continuous supply comprising positioning the open end of said tubular material onto a mandrel having a hollow generally package-shaped portion of cross-sectional area at least as large as that of the desired package and a fill opening at the desired site of the second closure of said package, forming a first closure for a package at the open end of said material adjacent said mandrel, forming a fill opening in said material adjacent the fill opening of said mandrel, filling said material through the fill openings in said material and mandrel with the desired contents of said package, removing the package from said mandrel subsequent to filling, severing said package from the continuous supply adjacent said fill opening and forming the second closure of said package adjacent the severed end of said material to form a closed filled package.

6. The method according to claim 5 wherein the step of removing the package from said mandrel comprises advancing said package off of said mandrel prior to severing said package from the continuous supply to draw attached material over the hollow portion of said mandrel for formation of a subsequent package.

7. The method according to claim 6 comprising the step of commencing the forming and filling of said subsequent package simultaneous with the remaining steps of said method with respect to the previous package.

8. The method according to claim 6 wherein the step of advancing said package off of said mandrel comprises pulling said first closure away from said mandrel a distance sufficient to remove said package from said mandrel and then pushing said closure toward said mandrel a short distance to settle the contents within said package.

9. The method according to claim 5 wherein said mandrel is oriented vertically to form and fill said packages in vertical orientation.

10. The method according to claim 5 wherein the step of forming the second closure comprises applying a twist tie to the severed end of said material.

11. A method for forming and filling packages from open mesh tubular plastic netting in a continuous rope form supply comprising the steps of: expanding the open end of said netting onto a mandrel having a hollow generally package-shaped portion of cross-sectional area at least as large as that of the desired package and a fill opening at the desired site of the second closure of said package, forming a first closure for a package at the open end of said netting adjacent said mandrel, forming a fill opening in said netting adjacent the fill opening of said mandrel, filling said netting through the fill openings in said netting and mandrel with the desired contents of said package, removing the filled package from said mandrel subsequent to filling, severing said package from the continuous supply adjacent said fill opening and forming the second closure of said package adjacent the severed end of said netting to form a closed filled package.

12. The method according to claim 11 wherein the step of expanding the open end of said netting onto a mandrel comprises cross-sectionally expanding said netting beyond the desired cross-sectional area of said package, and longitudinally gathering a relaxed supply of the expanded netting adjacent the hollow portion of said mandrel.

13. The method according to claim 11 wherein the step of forming a first closure comprises clamping the open end of said netting to define a generally flat outwardly extending section of said netting, positioning a "V"-shaped elongate label closure about the outwardly extending section of said netting, and adhering the opposing faces of said label closure with said section of netting therebetween to form said first closure.

14. The method according to claim 11 wherein the step of forming a fill opening comprises transversely slitting a portion of said netting.

15. The method according to claim 11 wherein the step of removing the filled package from said mandrel comprises advancing said package off of said mandrel prior to severing said package to draw attached netting onto said mandrel for formation of a subsequent package.

16. The method according to claim 15 comprising the step of commencing the forming and filling of said subsequent package simultaneous with the remaining steps of said method with respect to the previous package.

17. The method according to claim 16 wherein the step of advancing said package off of said mandrel comprises pulling said first closure away from said mandrel a distance sufficient to remove said package from said mandrel and then bumping said closure toward said mandrel a short distance to settle the contents within said package.

18. The method according to claim 11 wherein said mandrel is oriented vertically to form and fill said packages in vertical orientation.

19. The method according to claim 11 wherein the step of forming a second closure comprises applying a twist tie to the severed end of said netting.

20. A method for forming and filling packages from open mesh tubular plastic netting in a continuous rope form supply comprising the steps of: drawing the open end of said netting onto a mandrel having a diverging portion cross-sectionally expanding said netting to at least the desired cross-sectional area of said package, an intermediate portion, a hollow generally package-shaped portion of cross-sectional area at least as large as that of the desired package and a fill opening at the desired site of the end of said package, longitudinally gathering a relaxed supply of the expanded netting on the intermediate portion of said mandrel, forming a first closure for a package at the open end of said netting adjacent said mandrel, forming a fill opening in said netting adjacent the fill opening of said mandrel, filling said netting through the fill openings in said netting and mandrel with the desired contents of said package, advancing the filled package off of said mandrel to draw attached netting from the intermediate portion of said mandrel onto the hollow portion thereof for formation of a subsequent package, and severing said package from the continuous supply adjacent said fill opening after advancing.

21. Apparatus for forming and filling packages from tubular packaging material in a continuous supply comprising: shaping means for forming the portion adjacent the open end of said tubular material into a hollow configuration generally defining a package shape, clamping means for clamping the open end of said material to define a generally flat outwardly extending section of said material, transfer means for positioning a label closure adjacent the outwardly extending section of said material, means for adhering said label closure to said section of material, opening means for forming a fill opening in said material adjacent the desired site of the other end of said package, filling means for filling said material through the fill opening therein with the desired contents of said package, and cutter means for severing said material from the continuous supply adjacent said fill opening subsequent to filling.

22. Apparatus according to claim 21 wherein said shaping means comprises a mandrel having a hollow generally package-shaped portion of cross-sectional area at least as large as that of the desired package and a fill opening at the desired site of the end of said package.

23. Apparatus according to claim 22 comprising a plurality of rollers disposed about and supporting said mandrel within said material, said material passing between said rollers and said mandrel.

24. Apparatus according to claim 21 comprising a continuous supply of double-width label closure material, folding means for folding the end of said double-width label closure material to form a length of "V"-shaped label closure material sufficiently dimensioned to receive the outwardly extending section of said material and label cutter means for severing said length of label closure material from the continuous supply.

25. Apparatus according to claim 24 wherein said folding means comprises a label folding mandrel and a pair of pinch rollers drawing said double-width label closure material over said folding mandrel.

26. Apparatus according to claim 24 wherein said label cutter means comprises a scissors.

27. Apparatus according to claim 24 wherein said opening means comprises a slitter knife and means for translating said slitter knife transverse a portion of said material.

28. Apparatus according to claim 21 wherein said cutter means comprises a scissors.

29. Apparatus for forming and filling packages from open mesh tubular plastic netting in a continuous rope form supply comprising: a mandrel having a diverging portion for cross-sectionally expanding said netting to at least the desired cross-sectional area of said package, an intermediate portion, a hollow generally package-shaped portion of cross-sectional area at least as large as that of the desired package and a fill opening at the desired site of the end of said package, support means for supporting said mandrel within said netting, supply means for drawing said netting over the diverging portion of said mandrel to gather a relaxed supply of expanded netting on the intermediate portion of said mandrel, means for forming a first closure for a package at the open end of said netting adjacent said mandrel, opening means for forming a fill opening in said netting adjacent the fill opening of said mandrel, filling means for filling said netting through the fill openings in said netting and mandrel with the desired contents of said package, package advancement means for advancing the filled package off of said mandrel to draw attached netting from the intermediate portion of said mandrel onto the hollow portion thereof for formation of a subsequent package, and cutter means for severing said package from the continuous supply adjacent said fill opening after advancement.

30. Apparatus according to claim 29 wherein said mandrel is vertically oriented to form and fill said packages in vertical orientation.

31. Apparatus according to claim 29 comprising a spherical guide mounted at the end of said mandrel adjacent the diverging section for guiding said netting onto said mandrel.

32. Apparatus according to claim 29 wherein said support means comprises a plurality of rollers disposed about and supporting said mandrel within said netting, said netting passing between said rollers and said package.

33. Apparatus according to claim 32 wherein said supply means comprises means for driving at least one of said rollers.

34. Apparatus according to claim 29 wherein said package advancement means comprises means for pulling said first closure away from said mandrel a distance sufficient to remove said package from said mandrel and means for bumping said closure a short distance toward said mandrel to settle the contents within said package.

35. Apparatus according to claim 29 comprising second closure means for applying a second closure to the severed end of said package.

36. Apparatus according to claim 35 wherein said second closure means comprises means for applying a twist tie to the severed end of said package.

37. Apparatus according to claim 35 wherein said second closure means is disposed laterally offset from said mandrel and comprising transfer means for laterally translating the severed package to said second closure means.

38. Apparatus according to claim 37 wherein said transfer means comprises a carriage mounted for lateral movement and a transfer clamp carried on said carriage for clamping said netting adjacent said mandrel, said cutter means being carried on said carriage adjacent said transfer clamp and being operative to sever said package from the continuous supply subsequent to engagement of said netting by said transfer clamp.

39. Apparatus according to claim 30 wherein the desired contents of said package comprise spherical objects such as oranges and wherein said filling means comprises a downwardly inclined conveyor for said spherical objects and means for driving said conveyor to accelerate and impart backspin to said spherical objects causing said spherical objects to rebound downwardly off the interior of said mandrel.

40. Apparatus for forming and filling packages from open mesh tubular plastic netting in a continuous rope form supply comprising: a vertically oriented mandrel having an upper diverging portion for cross-sectionally expanding said netting beyond the desired cross-sectional area of said package, an intermediate portion, a lower hollow generally package shaped portion of cross-sectional area at least as large as that of the desired package and a fill opening at the desired site of the second closure of said package, a plurality of rollers disposed about and supporting said mandrel within said netting, supply means for drawing said netting over the diverging portion of said mandrel to gather a relaxed supply of expanded netting on the intermediate portion of said mandrel, means for clamping the open end of said netting adjacent the bottom of said mandrel to define a generally flat downwardly extending section of said netting, means for applying an elongate label closure to the downwardly extending section of said netting, opening means for forming a fill opening in said netting adjacent the fill opening of said mandrel, filling means for filling said netting through the fill openings in said netting and mandrel with the desired contents of said package, package advancement means for drawing the filled package downwardly off of said mandrel to draw attached netting from the intermediate portion of said mandrel onto the hollow portion thereof for formation of a subsequent package, transfer clamp means for clamping the advanced package adjacent said fill opening, cutter means for severing the transfer clamped netting adjacent the fill opening from the continuous supply and upper closure means for applying an upper closure to the transfer clamped end of said package.

41. A method for forming and filling packages from tubular packaging material in a continuous supply comprising positioning the open end of said tubular material onto a mandrel having a generally package-shaped portion, forming a first closure for a package at the open end of said material adjacent said mandrel, forming a fill opening in said material adjacent the desired site of the second closure of said package, filling said material through said fill opening with the desired contents of said package, pulling said first closure to remove the package from said mandrel, severing said package from the continuous supply adjacent said fill opening and forming the second closure of said package adjacent the severed end of said material to form a closed filled package.

42. Apparatus for forming and filling packages from tubular packaging material in a continuous rope form supply comprising: a mandrel having a hollow generally package-shaped portion and a fill opening at the desired site of the end of said package, supply means for drawing said material over the hollow portion of said mandrel, means for forming a first closure for a package at the open end of said material adjacent said mandrel, opening means for forming a fill opening in said material adjacent the fill opening of said mandrel, filling means for filling said material through the fill openigs in said material and mandrel with the desired contents of said package, package advancement means for pulling said first closure to advance the filled package off of said mandrel to draw attached material onto the hollow portion thereof for formation of a subsequent package, and cutter means for severing said package from the continuous supply adjacent said fill opening after advancement.

43. A mandrel for forming and filling packages from open mesh tubular plastic netting in a continuous rope form supply comprising: a conical diverging portion for cross-sectionally expanding said netting beyond the desired cross-sectional area of said package, a package forming portion, an intermediate portion disposed between said diverging portion and said package forming portion and supply means for drawing said netting over the diverging portion of said mandrel to gather a relaxed supply of expanded netting on the intermediate portion of said mandrel.

44. Apparatus according to claim 43 comprising a spherical guide mounted at the end of said mandrel adjacent the diverging portion for guiding said netting onto said mandrel.

* * * * *